US011745367B2

(12) United States Patent
Komori et al.

(10) Patent No.: US 11,745,367 B2
(45) Date of Patent: Sep. 5, 2023

(54) BLADE UNIT AND ELECTRIC RAZOR

(71) Applicant: Panasonic Intellectual Property Management Co., Ltd., Osaka (JP)

(72) Inventors: Shunsuke Komori, Shiga (JP); Toshiharu Hashimoto, Osaka (JP); Shoki Okura, Shiga (JP); Atsutaka Ikemoto, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/586,247

(22) Filed: Jan. 27, 2022

(65) Prior Publication Data

US 2022/0314473 A1 Oct. 6, 2022

(30) Foreign Application Priority Data

Mar. 30, 2021 (JP) ..... 2021-058840

(51) Int. Cl.
*B26B 19/10* (2006.01)
*B26B 19/38* (2006.01)

(52) U.S. Cl.
CPC ..... *B26B 19/10* (2013.01); *B26B 19/3813* (2013.01)

(58) Field of Classification Search
CPC ... B26B 19/10; B26B 19/3813; B26B 19/046; B26B 19/38
USPC ..... 30/346.51
See application file for complete search history.

(56) References Cited

U.S. PATENT DOCUMENTS 6,293,017 B1 9/2001 Sato et al.
2012/0055025 A1* 3/2012 Pohl ..... B26B 19/06 30/34.1
2016/0257008 A1* 9/2016 Sato ..... B26B 19/048

FOREIGN PATENT DOCUMENTS

EP 1930135 A1 * 6/2008 ..... B26B 19/046
EP 2425938 A1 * 3/2012 ..... B26B 19/04
JP H0796083 A * 4/1995
JP 11-267376 A 10/1999
JP 3747620 B2 2/2006
JP 2011067422 A * 4/2011 ..... B26B 19/04

* cited by examiner

*Primary Examiner* — Nhat Chieu Q Do
(74) *Attorney, Agent, or Firm* — McDermott Will & Emery LLP

(57) ABSTRACT

An electric razor reduces damage to the skin during shaving. The electric razor includes a head portion that holds a comb-shaped outer blade and mesh-shaped outer blades each of which extends in a first direction so as to be movable in a second direction intersecting the first direction, comb blade urging members that urge the comb-shaped outer blade in the second direction, mesh blade urging members that urge the mesh-shaped outer blades in the second direction, and an engaging mechanism that, when the mesh-shaped outer blades are moved toward a unit base against urging force of the mesh blade urging members, moves the comb-shaped outer blade in a state where the comb-shaped outer blade does not protrude from the mesh-shaped outer blades with respect to the unit base.

9 Claims, 16 Drawing Sheets

BLADE UNIT AND ELECTRIC RAZOR

CROSS-REFERENCE OF RELATED APPLICATIONS

This application claims the benefit of Japanese Application No. 2021-058840, filed on Mar. 30, 2021, the entire disclosures of which Application is incorporated by reference herein.

BACKGROUND

1. Technical Field

The present disclosure relates to a blade unit for shaving a body hair of an animal such as a human, and an electric razor.

2. Description of the Related Art

Conventionally, there is a blade unit comprising a plurality of types of outer blades. Such a blade unit is used for an electric razor. When the blade unit is pressed against a skin surface when using an electric razor, the blade unit is configured such that each outer blade sinks independently according to the unevenness of the skin. The blade unit described in PTL 1 employs a mechanism in which each outer blade sinks independently within a predetermined range, and each outer blade sinks in conjunction with each other when the predetermined range is exceeded.

CITATION LIST

Patent Literature

PTL 1: Unexamined Japanese Patent Publication No. H11-267376

SUMMARY

However, the conventional blade unit has a structure that allows other types of outer blades to sink more than a slit-shaped outer blade that scoops up and cuts relatively long hair, so that an edge of a tip of the slit-shaped outer blade could cause severe damage to the skin.

The present disclosure has been made in view of the above problem, and an object of the present disclosure is to provide a blade unit in which an outer blade for scooping up body hair does not project more than other types of outer blades, and an electric razor provided with the blade unit.

In order to achieve the above object, the electric razor, which is one of the present disclosures, is an electric razor comprising a head portion comprising a comb-shaped outer blade and at least one mesh-shaped outer blade, the head portion holding the comb-shaped outer blade and the at least one mesh-shaped outer blade each extending in a first direction so as to be movable in a second direction intersecting the first direction, wherein the electric razor comprises a comb blade urging member that urges the comb-shaped outer blade with respect to the head portion in the second direction, a mesh blade urging member that urges the at least one mesh-shaped outer blade with respect to the head portion in the second direction, and an engaging mechanism that, when the at least one mesh-shaped outer blade is moved toward the head portion against urging force of the mesh blade urging member, moves the comb-shaped outer blade in a state where the at least one mesh-shaped outer blade projects from the comb-shaped outer blade with respect to the head portion.

Furthermore, in order to achieve the above object, another blade unit of the present disclosure is a blade unit configured to be attached to an electric razor, comprising a comb-shaped outer blade and at least one mesh-shaped outer blade, the blade unit comprising a unit base that holds the comb-shaped outer blade extending and the at least one mesh-shaped outer blade each in a first direction so as to be movable in a second direction intersecting the first direction, a comb blade urging member that urges the comb-shaped outer blade with respect to the unit base in the second direction, a mesh blade urging member that urges the at least one mesh-shaped outer blade with respect to the unit base in the second direction; and an engaging mechanism that, when the at least one mesh-shaped outer blade is moved toward the unit base against urging force of the mesh blade urging member, moves the comb-shaped outer blade in a state where the comb-shaped outer blade does not project from the at least one mesh-shaped outer blade with respect to the unit base.

In the present disclosure, while the comb-shaped outer blade exerts a higher scooping effect than the mesh-shaped outer blades for hairs growing in different directions or lying hairs, it is possible to achieve both a high hair scooping effect and suppression of damage to the skin due to the mechanism that prevents the comb-shaped outer blade from projecting more than the mesh-shaped outer blades.

DETAILED DESCRIPTION

Hereinafter, exemplary embodiments of a comb-shaped outer blade, a blade unit, and an electric razor according to the present disclosure will be described with reference to the drawings. It should be noted that the following exemplary embodiments are intended to give an example for explaining the present disclosure, and are not intended to limit the present disclosure. For example, a shape, a structure, a material, a component, a relative positional relationship, a connection state, a numerical value, a mathematical formula, contents of each stage in a method, an order of each stage, etc. shown in the following exemplary embodiments are examples, and may include contents that are not described below. Furthermore, geometric expressions such as parallel and orthogonal may be used, but these expressions do not indicate mathematical rigor, and include substantially permissible errors and deviations. In addition, expressions such as simultaneous and identical also include a substantially permissible range.

Furthermore, the drawings are schematic views in which emphasis, omission, and ratio adjustment are appropriately performed in order to describe the present disclosure, and may be different from actual shapes, positional relationships, and ratios.

Further, in the following, a plurality of disclosures may be comprehensively described as one exemplary embodiment. In addition, some of the contents described below are described as arbitrary components relating to the present disclosure.

Figure 1:
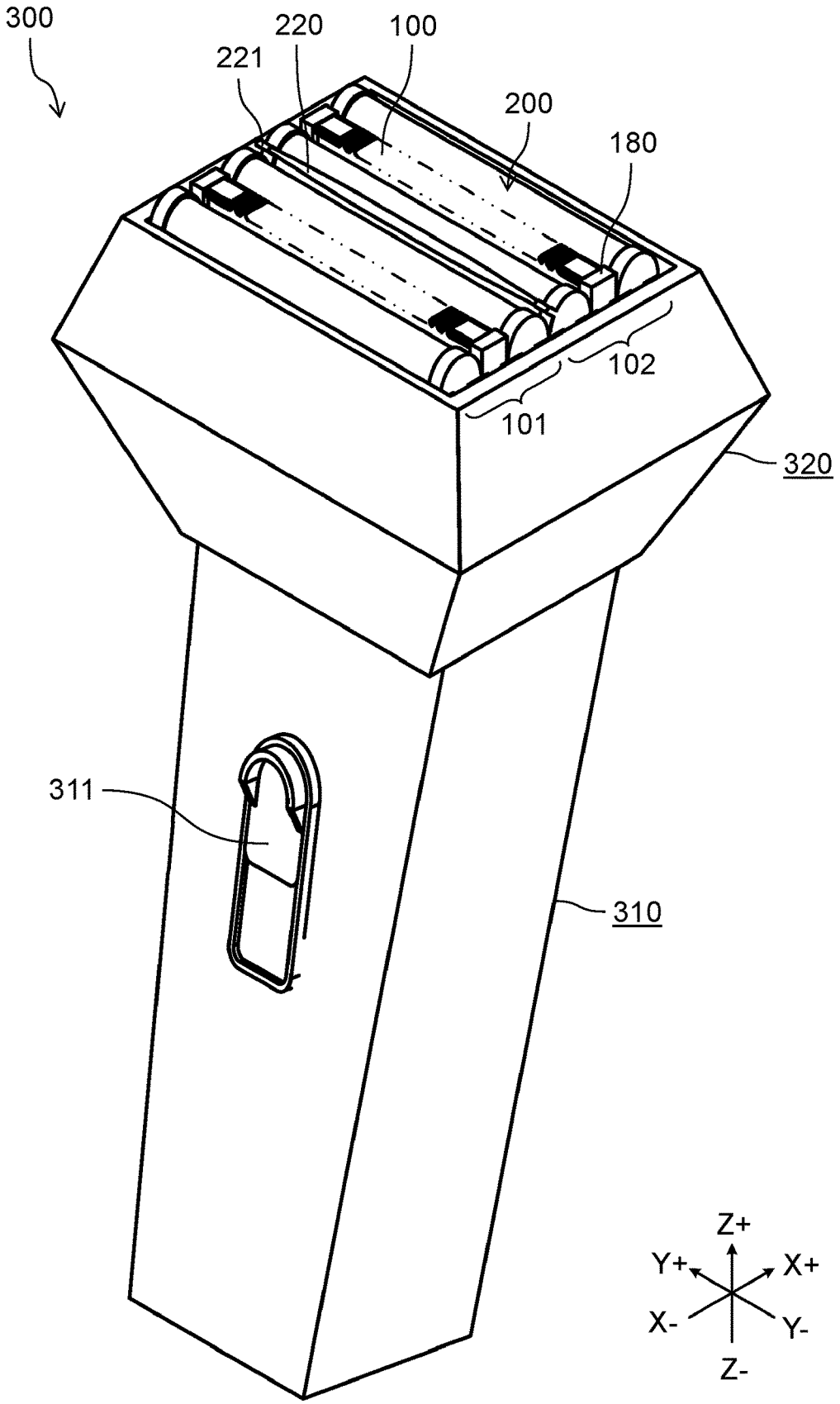
FIG. 1 is a perspective view illustrating an electric razor according to the present exemplary embodiment.

FIG. 1 is a perspective view illustrating an electric razor 300. Note that the electric razor 300 has a portion where an edge has been chamfered and unevenness for slip prevention has been provided, but these are not illustrated.

The electric razor 300 is a device for cutting and removing body hair such as a beard using an electric blade, and includes a grip portion 310 and a head portion 320.

The grip portion 310 is a portion gripped by a user when using the electric razor 300. In the case of the present exemplary embodiment, the grip portion 310 also functions as a housing for accommodating a control device that controls the drive of a shaving blade, a battery, and the like. A power-supply switch 311 or the like for turning on or off a power supply is provided on an outer surface of the grip portion 310.

The head portion 320 is a member to which a blade unit 200 provided with a blade for cutting body hair is detachably attached and connected to one end of the grip portion 310. In the case of the present exemplary embodiment, the head portion 320 is relatively operably connected to the grip portion 310. In the present exemplary embodiment, a Y-axis direction is a direction in which an outer blade and a sliding member extend, an X-axis direction is a direction in which the outer blade and the sliding member are arranged in parallel, and a Z-axis direction is a direction in which the outer blade is movable with respect to a unit base 230 (see FIG. 2) when the outer blade receives external force.

Figure 2:
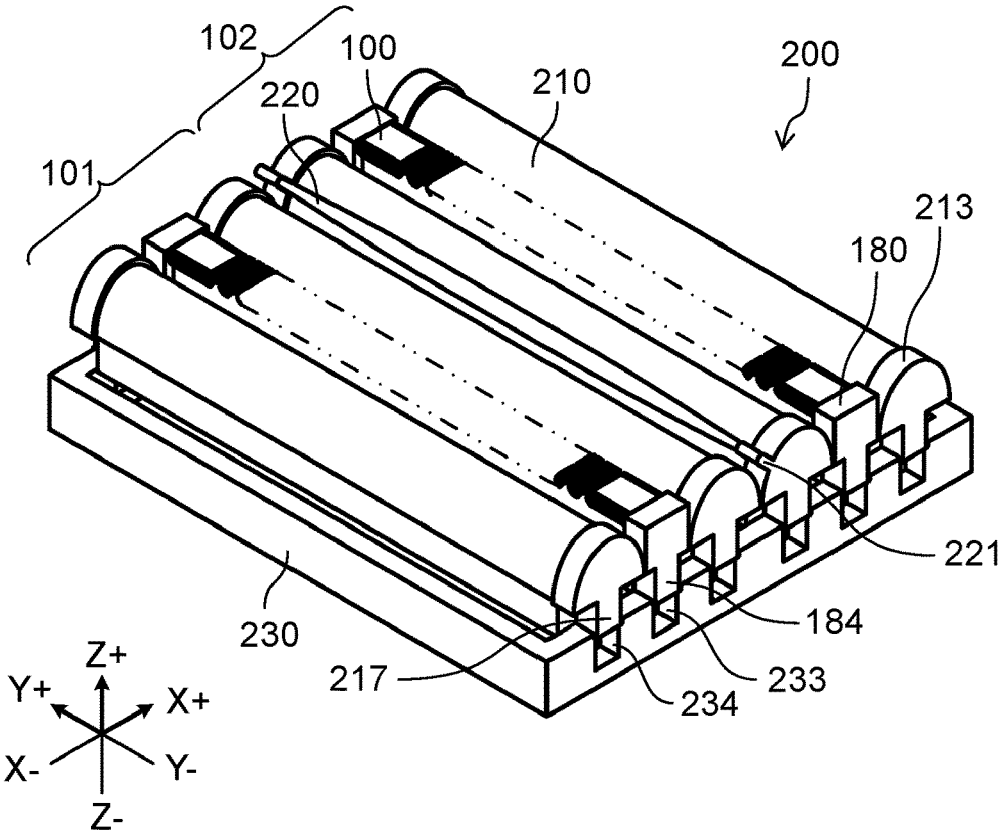
FIG. 2 is a perspective view illustrating a blade unit according to the present exemplary embodiment.

FIG. 2 is a perspective view illustrating the blade unit 200. The blade unit 200 is a unit to be replaced in the head portion 320 when a blade or the like deteriorates due to the use of the electric razor 300, and includes a comb-shaped outer blade 100, a mesh-shaped outer blades 210, a sliding member 220, and the unit base 230. Note that the comb-shaped outer blade 100 and the mesh-shaped outer blades 210 may be collectively referred to as outer blades.

In the case of the present exemplary embodiment, in a first direction (the Y-axis direction in the drawing) in which the outer blades extend, and a second direction (the Z-axis direction in the drawing) in which the outer blades move with respect to the unit base 230, and a third direction (the X-axis direction in the drawing) that intersects the first and second directions, the blade unit 200 includes a first set 101 and a second set 102, each of which is a set of blades in which the mesh-shaped outer blades 210 are arranged on both sides of the comb-shaped outer blade 100. The first set 101 is configured by three outer blades, each having a different function, and along the third direction, first mesh-shaped outer blades 210 suitable for shaving short hair, the comb-shaped outer blade 100 suitable for shaving long hair, and second mesh-shaped outer blades 210 suitable for shaving frizzy beards in addition to shaving short hair are arranged in this order. Furthermore, the second set 102 also has three outer blades having the same configuration as the first set 101. The first set 101 and the second set 102 are attached to the unit base 230 so as to be symmetrical with respect to a plane including the first direction and the second direction, and form six outer blades. With this arrangement, the comb-shaped outer blade 100 is disposed next to the mesh-shaped outer blades 210 in any of moving directions (X-axis direction in the drawing) of the electric razor 300 during shaving, and even when body hair in a narrow area such as under the nose is shaved, the comb-shaped outer blade 100 comes into contact with the skin, and it is possible to scoop up and cut relatively long body hair.

Figure 3:
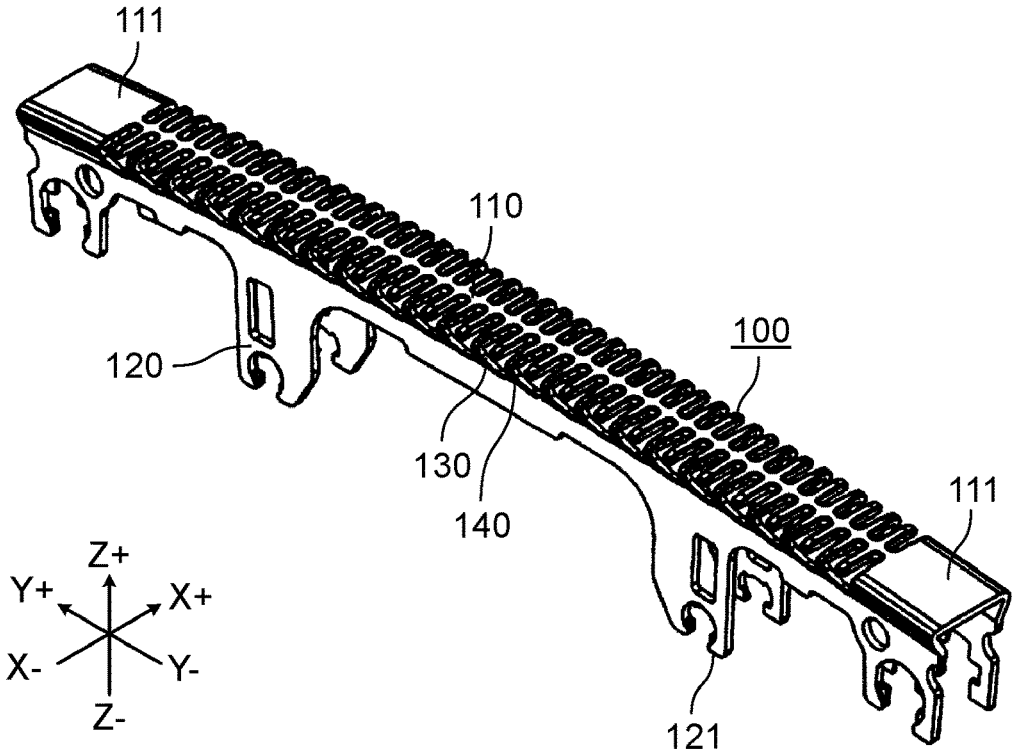
FIG. 3 is a perspective view illustrating a comb-shaped outer blade according to the present exemplary embodiment.
Figure 4:
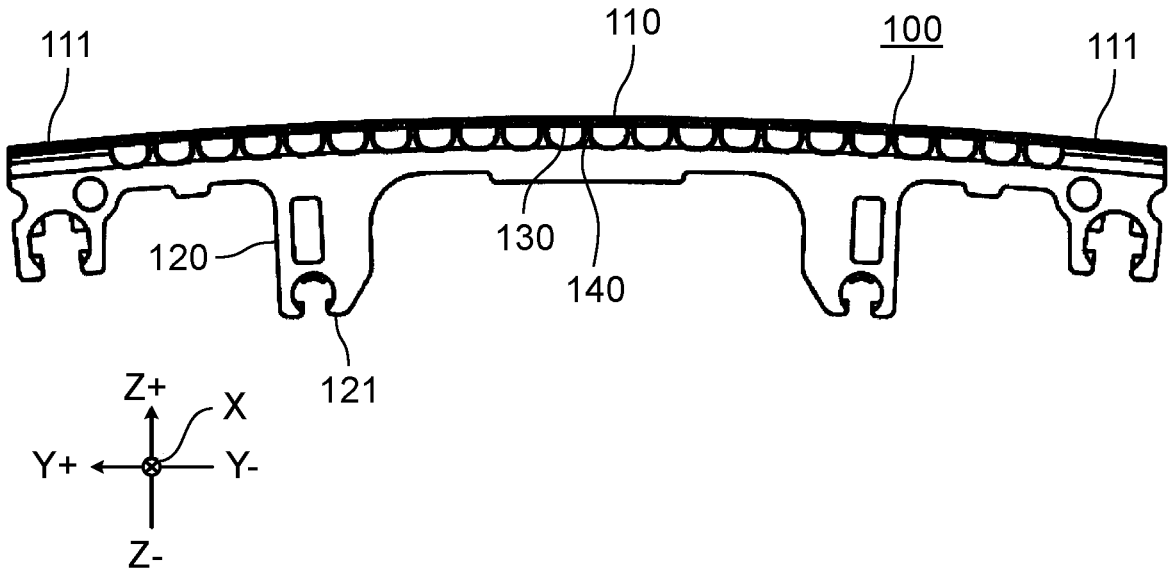
FIG. 4 is a side view of the comb-shaped outer blade according to the present exemplary embodiment.

FIG. 3 is a perspective view illustrating the comb-shaped outer blade 100. FIG. 4 is a side view of the comb-shaped outer blade 100. The shape of the comb-shaped outer blade 100 is not particularly limited as long as slits extending in the third direction are arranged in the first direction. In the case of the present exemplary embodiment, the comb-shaped outer blade 100 is an outer blade attached to the electric razor 300, and includes a base portion 110, an attaching portion 120, an open blade portion 130, and a bent blade portion 140. In the case of the present exemplary embodiment, in the comb-shaped outer blade 100, the base portion 110, the attaching portion 120, the open blade portions 130, and the bent blade portions 140 are integrally formed by punching and bending sheet metal with a press. Note that a processing method of the comb-shaped outer blade 100 may be sintering, injection molding, etching processing or electroforming processing, or may be produced by welding two members.

The base portion 110 is a rod-shaped portion extending in the first direction (Y-axis direction in the drawing). At both end portions of the base portion 110, long end portions 111 having the same bending shape as the bent blade portion 140 and longer in the first direction than the bent blade portion 140 are provided. In the case of the present exemplary embodiment, the base portion 110 is curved in an arc shape such that a central portion projects forward (Z+ side in the drawing) from both ends in a plane extending in the first direction and the second direction which is orthogonal to the first direction (inside the YZ plane in the drawing). Along with this, the plurality of the open blade portions 130 and the plurality of the bent blade portions 140 are arranged along the curvature of the base portion 110. Since the comb-shaped outer blade 100 is curved in a convex shape, the comb-shaped outer blade 100 can be fitted to a recessed portion such as under a human chin, and shaving efficiency can be improved.

The attaching portion 120 is a plate-shaped portion extending in the first direction and in the second direction which is orthogonal to the first direction. In the case of the present exemplary embodiment, the attaching portion 120 includes outer blade engaging claws 121 that engages with outer blade protruding portions 183 of comb blade holding members 180, which will be described later (see FIG. 8).

Figure 5:
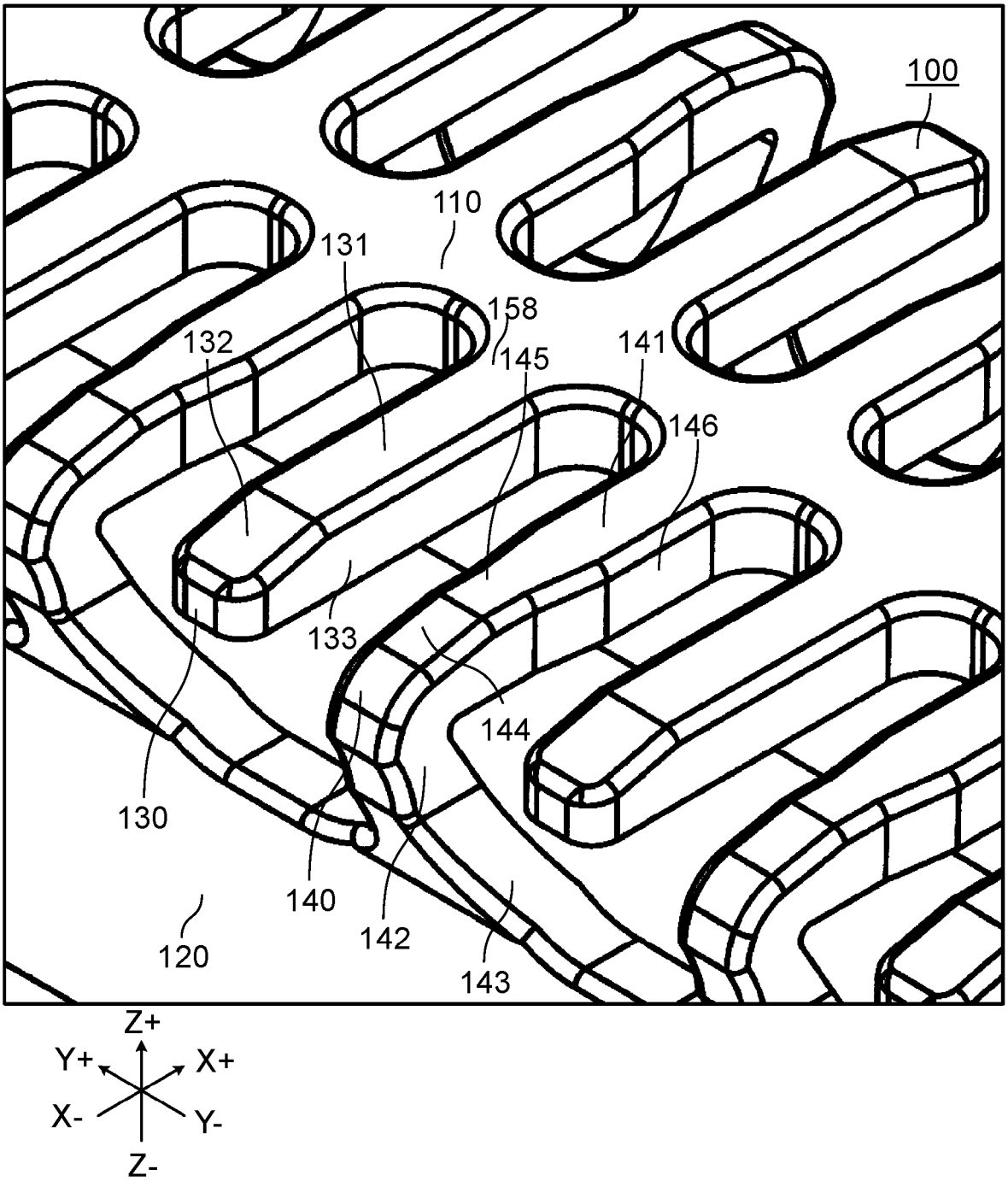
FIG. 5 is a perspective view illustrating the vicinity of open blade portions and bent blade portions according to the present exemplary embodiment.
Figure 6:
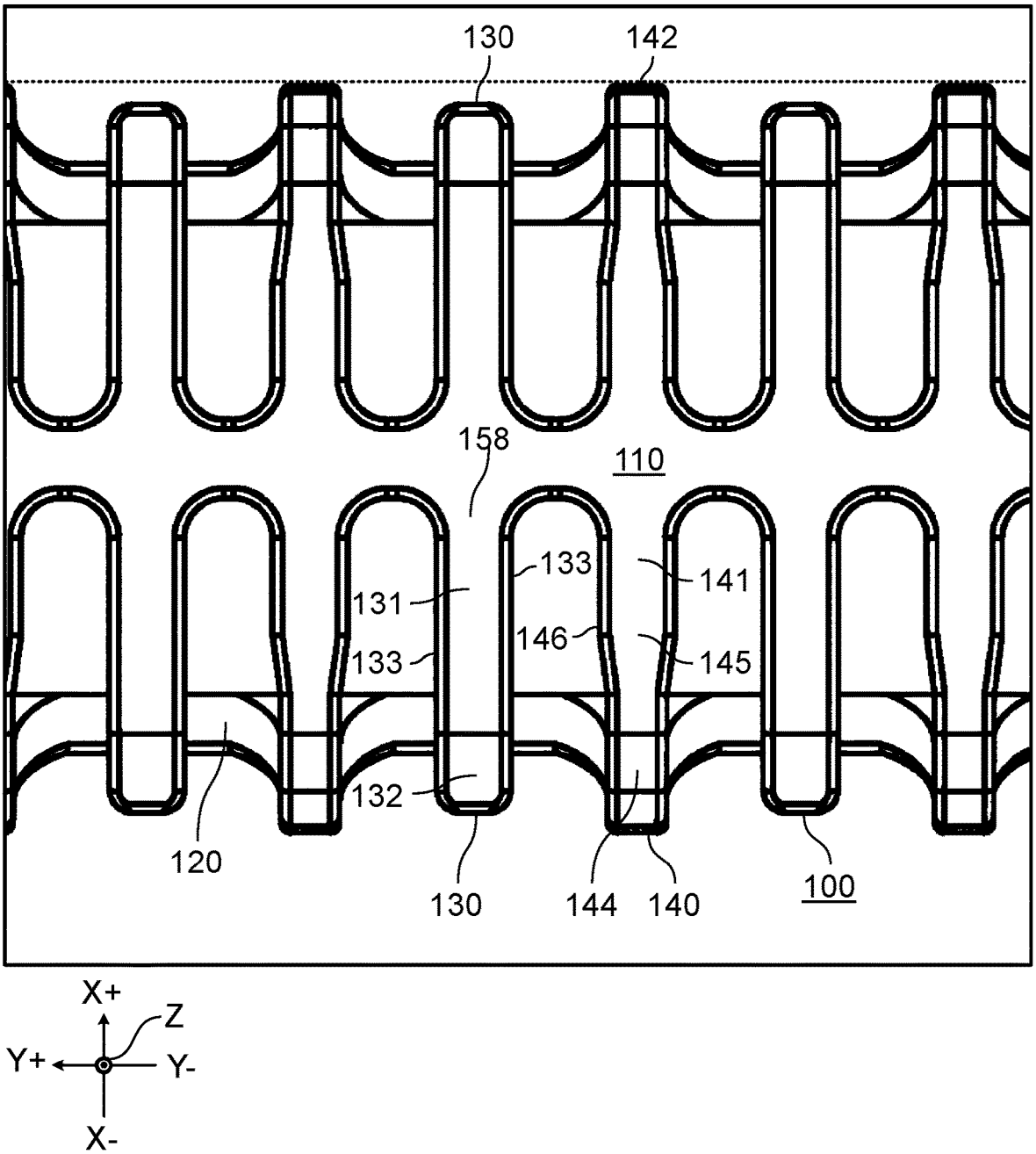
FIG. 6 is a plan view illustrating the vicinity of the open blade portions and the bent blade portions according to the present exemplary embodiment.

FIG. 5 is a perspective view illustrating the vicinity of the open blade portions 130 and the bent blade portions 140. FIG. 6 is a plan view illustrating the vicinity of the open blade portions 130 and the bent blade portions 140. The open blade portion 130 is a cantilever rod-shaped portion projecting from the base portion 110 in the third direction (X-axis direction in the drawing) orthogonal to the first direction and the second direction, and scoops up so-called lying body hair with a tip in an open state, guides it between the adjacent blade portions, and cuts the body hair with a first inner blade 170, details of which will be described later (see FIG. 8), that reciprocates relatively.

In the case of the present exemplary embodiment, the open blade portion 130 extends in the first direction and the third direction (XY plane in the drawing), includes an open upper surface portion 131 that is flush with the base portion 110, and has a rectangular rod shape as a whole.

A tip of the open upper surface portion 131 in the third direction includes an open inclined surface portion 132 that approaches the attaching portion 120 as a distance from the base portion 110 increases. The thickness of the tip of the open blade portion 130 (the length in the Z-axis direction in the drawing) reduces at the open inclined surface portion 132, so that even body hair extending along the edge of a skin surface can be effectively scooped up.

The corners of the open upper surface portion 131 and an open side surface portion 133 of the open blade portion 130 are loosely connected by R chamfering or the like. Furthermore, the open side surface portion 133 and the open inclined surface portion 132, and the open inclined surface portion 132 and a surface of the tip are also loosely connected by R chamfering or the like. As a result, damage to the skin when the comb-shaped outer blade 100 rubs against the skin surface is reduced.

The bent blade portions 140 are arranged side by side with the open blade portions 130 in the first direction, and are portions connected to the base portion 110 and the attaching portion 120. In the case of the present exemplary embodiment, the bent blade portions 140 and the open blade portions 130 are arranged side by side in parallel alternately. The inventors have obtained knowledge by experiment that, even when the bent blade portions 140 and the open blade portions 130 are arranged alternately, it is possible to obtain the same body hair scooping effect as when the plurality of the open blade portions 130 are arranged between the bent blade portions 140. Furthermore, this makes it possible to maintain a high structural strength of the comb-shaped outer blade 100.

The bent blade portion 140 includes a projecting portion 141 projecting from the base portion 110 along the third direction, a bent portion 142 bending (i.e., curving) from a tip of the projecting portion 141 toward the attaching portion 120, and a connecting portion 143. The connecting portion 143 is inclined in such a manner that the connecting portion 143 approaches the base portion 110 in the third direction as a distance from the bent portion 142 increases in the second direction and that the connecting portion 143 connects the bent portion 142 with the attaching portion 120. By using the bent blade portion 140 having such a shape, an angle formed by the projecting portion 141 and the connecting portion 143 is an acute angle, so that the bent portion 142 arranged at the tip effectively scoops up the lying body hair while reducing damage to the skin, and can guide the body hair between the adjacent blade portions.

In the case of the present exemplary embodiment, as shown by a broken line in FIG. 6, the end faces of the plurality of bent portions 142 are located at the same distance from the base portion 110 in the third direction, and are arranged at positions farther from the tip surfaces of the open blade portions 130 with respect to the base portion 110. As a result, the tips of the bent blade portions 140 come into contact with the skin before the tips of the open blade portions 130, so that the comb-shaped outer blade 100 as a whole can exert a high body hair scooping effect while reducing damage to the skin.

Furthermore, the bent blade portion 140 includes a bent inclined surface 144 disposed in substantially the same plane as the open inclined surface portion of adjacent the open blade portions 130, and the thickness of the bent portion 142 in the second direction is reduced to improve the effect of scooping up body hair. Similar to the open blade portion 130, the bent blade portion 140 has a corner portion between a bent upper surface portion 145 and a bent side surface portion 146 loosely connected by R chamfering or the like to reduce damage to the skin. The tip of the projecting portion 141 of the bent blade portion 140 is narrower than a base end portion 158 (namely, the length of the projecting portion 141 in the first direction is shorter than that of the base end portion 158). The base end portion 158 refers to a root portion of the open blade portion 130 connected to the base portion 110. As a result, the effect of guiding the scooped hair between the adjacent blade portions can be enhanced.

Figure 7:
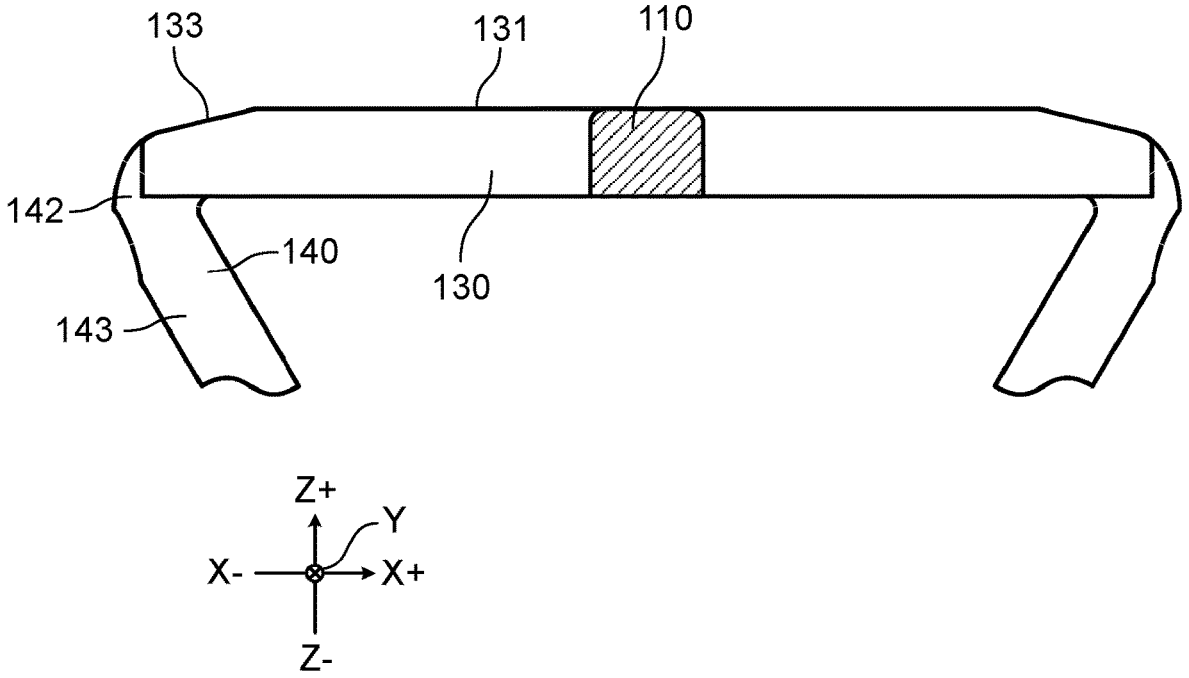
FIG. 7 is a diagram illustrating a state in which the bent blade portion and the open blade portion are arranged in a first direction and viewed from the first direction.

Further, as illustrated in FIG. 7, when the bent blade portions 140 and the open blade portions 130 are arranged in the first direction, the bent blade portions 140 are formed such that none of the parts of the open blade portions 130 project from the bent blade portions 140. As a result, damage to the skin of the comb-shaped outer blade 100 is suppressed.

Figure 8:
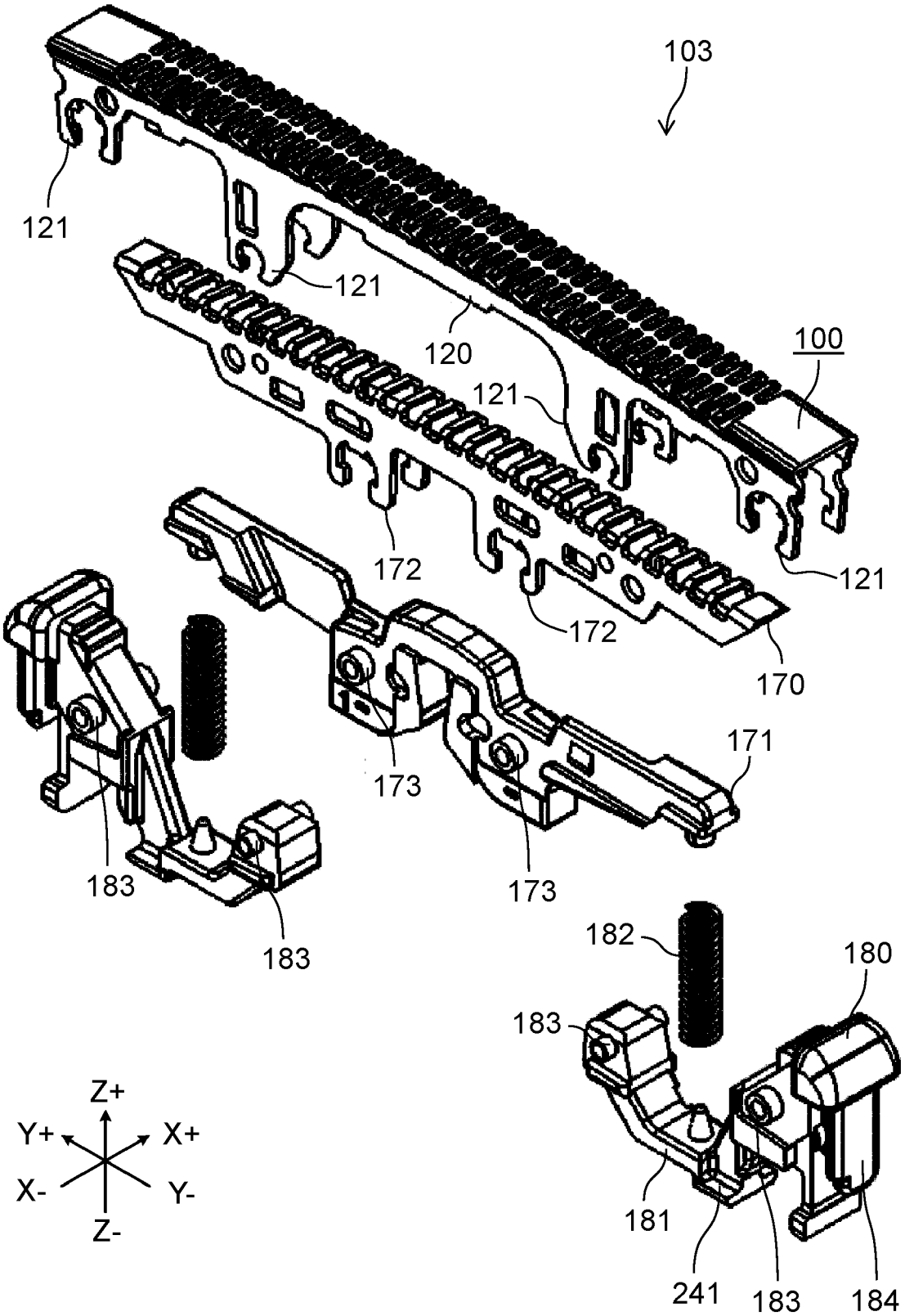
FIG. 8 is a perspective view illustrating a comb blade unit having the comb-shaped outer blade according to the present exemplary embodiment in an exploded manner.
Figure 9:
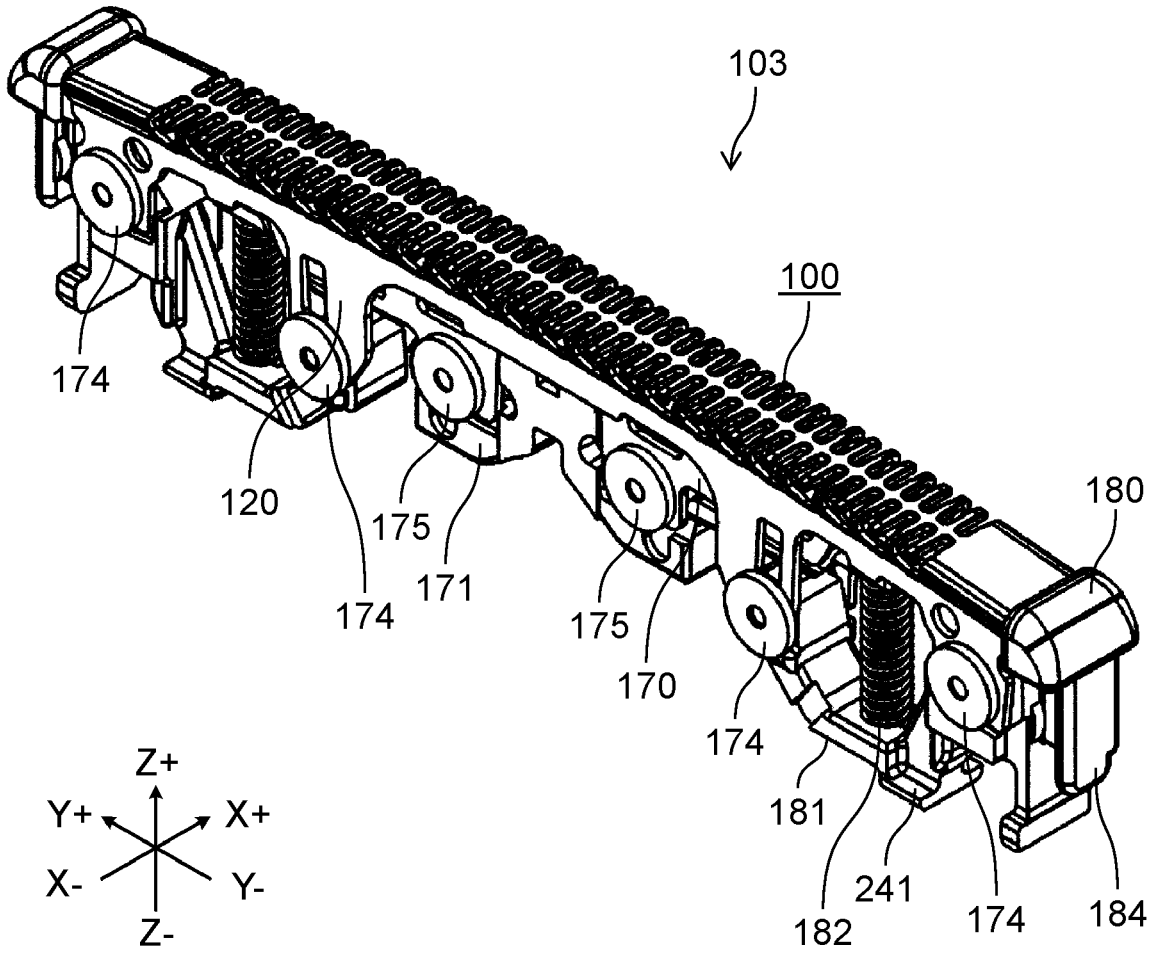
FIG. 9 is a perspective view illustrating the comb blade unit in an assembled state according to the present exemplary embodiment.

FIG. 8 is a perspective view illustrating a comb blade unit 103 having the comb-shaped outer blade 100 in an exploded manner FIG. 9 is a perspective view illustrating the comb blade unit 103 in an assembled state. As illustrated in these figures, the comb blade unit 103 includes the comb-shaped outer blade 100, the first inner blade 170, the comb blade holding members 180, first urging members 182, and a first joint member 171.

The first inner blade 170 is disposed inside the comb-shaped outer blade 100 (that is, on an opposite side of the skin contact surface), and reciprocates in the first direction while rubbing against the comb-shaped outer blade 100, thereby cutting body hair inserted between the adjacent blades of the comb-shaped outer blade 100 (that is, between the open side surface portion 133 and the bent side surface portion 146). In the case of the present exemplary embodiment, the first inner blade 170 has a shape in which slits are arranged in the first direction. The first inner blade 170 is fixedly attached to first resin joint member 171. In the first inner blade 170, a drive connecting portion (not illustrated) extending from the head portion 320 is inserted into a recess provided in the center of the first joint member 171 to apply reciprocating driving force. The first joint member 171 is not specified as resin. The drive connecting portion is not specified as long as it can perform a function of drive transmission such as a metal pin or a molded product, or a round shape or a square shape.

The comb blade holding members 180 are resin members that are fixedly attached to both end portions of the comb-shaped outer blade 100 in the first direction. The comb blade holding members 180 integrally include first facing portions 181 facing the first inner blade 170 in the second direction. The first urging member 182 connected to the first joint member 171 is attached to the first facing portion 181. The first urging member 182 is a coil spring or the like, and allows reciprocating movement of the first inner blade 170 while pressing the first inner blade 170 against a back surface of the comb-shaped outer blade 100 via the first joint member 171 on the basis of the first facing portion 181.

A method of joining the comb-shaped outer blade 100 and the comb blade holding members 180 is not particularly limited. In the case of the present exemplary embodiment, the comb-shaped outer blade 100 and the comb blade holding members 180 are temporarily fixed by engaging the outer blade protruding portions 183 of the comb blade holding members 180 and the outer blade engaging claws 121 of the attaching portion 120 with each other. Then, the tips of the outer blade protruding portions 183 are melted and expanded to form first melt-expanded portions 174, and the comb-shaped outer blade 100 and the comb blade holding members 180 are fixed. Furthermore, a material of the comb blade holding members 180 is not limited to resin, and a method of fixing the comb blade holding members 180 to the comb-shaped outer blade 100 may be one of caulking, hook engagement and welding, or a combination thereof.

A method of joining the first inner blade 170 and the first joint member 171 is not particularly limited. In the case of the present exemplary embodiment, the method of joining the first inner blade 170 and the first joint member 171 is the same as the method of joining the comb-shaped outer blade 100 and the comb blade holding members 180. The first inner blade 170 made of metal is provided with inner blade engaging claws 172, and is temporarily fixed by hook-engaging to cylindrical inner blade engaging protrusions 173 provided on the first joint member 171. Then, the tips of the inner blade engaging protrusions 173 are melted and expanded to form second melt-expanded portions 175, and the first inner blade and the first joint member 171 are fixed. Although the first melt-expanded portions 174 and the second melt-expanded portions 175 are simplified and drawn in FIG. 9, the first melt-expanded portion 174 and the second melt-enlarged portion 175 are portions in which resin is melted, expanded and hardened, and actually have a complicated shape.

Figure 10:
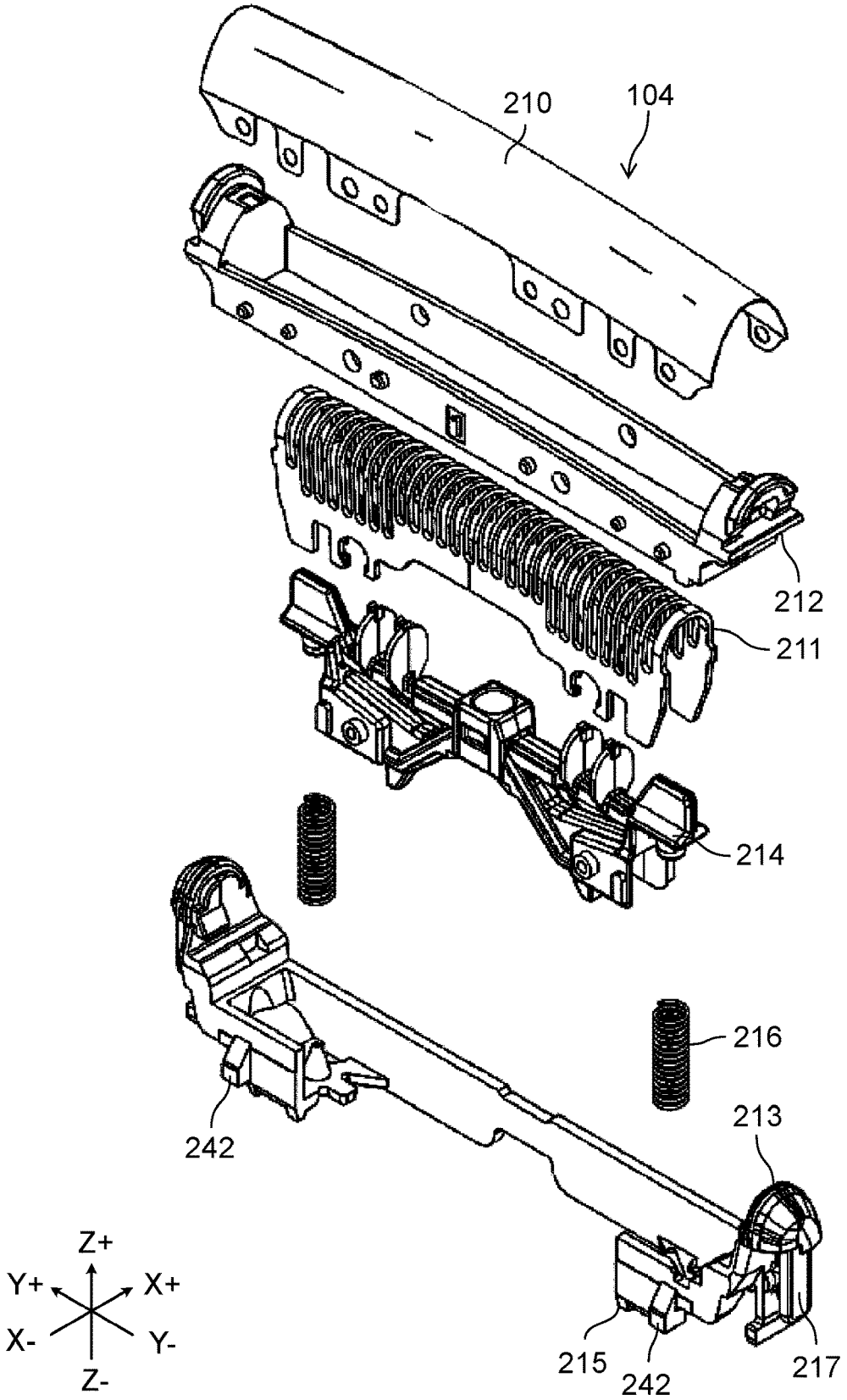
FIG. 10 is a perspective view illustrating a mesh-shaped blade unit having a mesh-shaped outer blade according to the present exemplary embodiment in an exploded manner.
Figure 11:
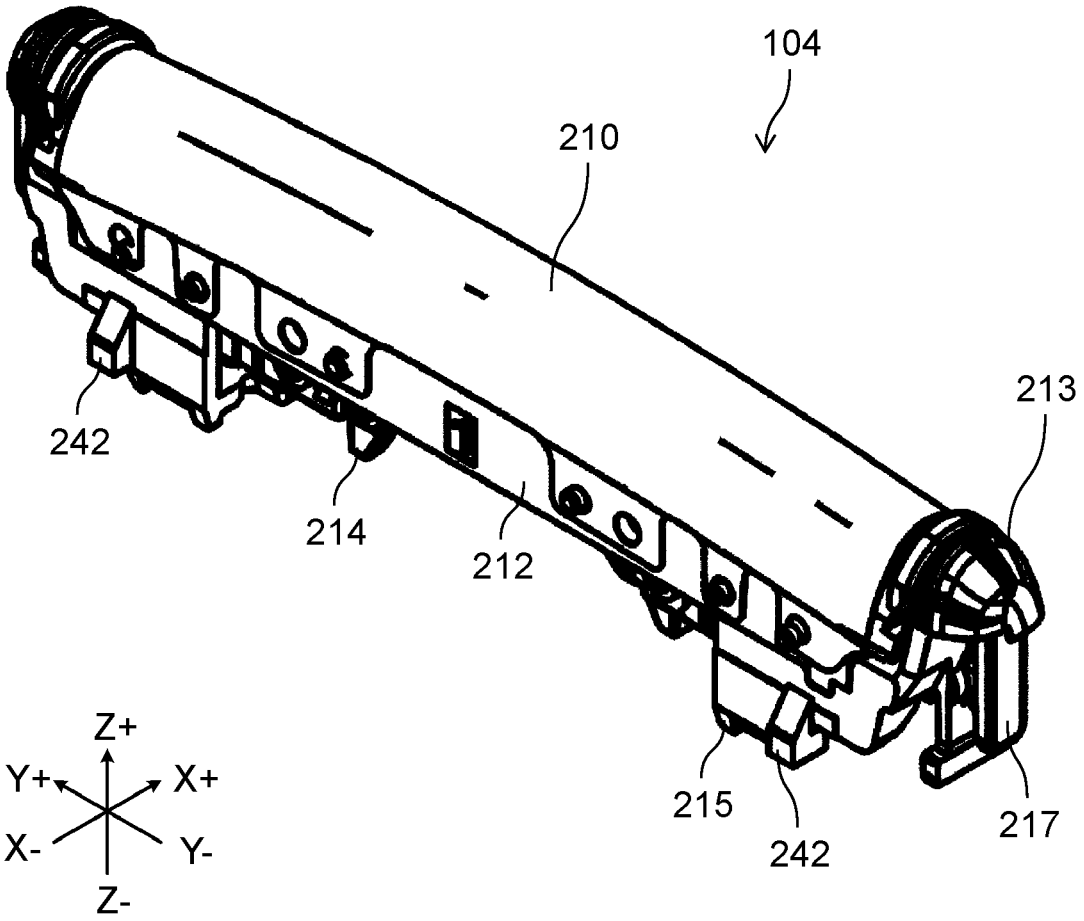
FIG. 11 is a perspective view illustrating the mesh-shaped blade unit in the assembled state according to the present exemplary embodiment.

FIG. 10 is a perspective view illustrating a mesh-shaped blade unit 104 having the mesh-shaped outer blades 210 in an exploded manner FIG. 11 is a perspective view illustrating the mesh-shaped blade unit 104 in the assembled state. As illustrated in these figures, the mesh-shaped blade unit 104 includes the mesh-shaped outer blades 210, a second inner blade 211, a mesh blade fixing member 212, mesh blade holding members 213, a second urging member 216, and a second joint member 214.

The mesh-shaped outer blades 210 is an outer blade for an electric razor attached to the electric razor 300, and extends in the first direction along the comb-shaped outer blade 100, and is curved in a plane extending in the second direction and the third direction (in the XZ plane in the drawing). In the case of the present exemplary embodiment, similarly to the base portion 110 of the comb-shaped outer blade 100, the mesh-shaped outer blades 210 is curved in an arc shape such that a central portion projects forward (Z+side in the drawing) from both ends in a plane extending in the first direction and the second direction (inside the YZ plane in the drawing). In addition, since the mesh-shaped outer blades 210 is curved in a convex shape, the comb-shaped outer blade 100 can be fitted to a recessed part such as under a person's jaw, and the effect that makes it possible to improve the shaving efficiency is the same as that of the comb-shaped outer blade 100, and the effect can be further enhanced because of the curves of both the comb-shaped outer blade 100 and the mesh-shaped outer blades 210.

The mesh-shaped outer blades 210 is a semi-cylindrical outer blade having a plurality of through-holes in a mesh shape, and is used for cutting relatively short body hair. In the case of the present exemplary embodiment, the mesh-shaped outer blades 210 is formed by processing a large number of through-holes by pressing on a sheet metal thinner than the sheet metal constituting the comb-shaped outer blade 100, and is fixed to the resin-made mesh blade fixing member 212 so as to maintain a curved state. Note that, a processing method of the mesh-shaped outer blades 210 may be sintering, injection molding, etching processing, or electroforming, and a method of fixing the mesh-shaped outer blades 210 and the mesh blade fixing member 212 may be a processing method such as welding with two members, or another processing method or fixing method.

The second inner blade 211 is disposed inside the mesh-shaped outer blades 210 and reciprocates in the first direction while rubbing against the mesh-shaped outer blades 210, so that relatively short body hairs inserted into the through-holes of the mesh-shaped outer blades 210 are cut. In the case of the present exemplary embodiment, the second inner blade 211 has a shape in which arch-shaped blades each of which is curved in a plane extending in the second direction and the third direction have been arranged in the first direction in such a manner that a slit is interposed between adjacent two arch-shaped blades. The second inner blade 211 is fixedly attached to the second joint member 214 made of resin. In the second inner blade 211, a drive connecting portion (not illustrated) extending from the head portion 320 is inserted into a recess provided in the center of the second joint member 214 to apply reciprocating driving force. Note that the drive connecting portion may be a metal pin or a molded product as a material, and a round shape, a square shape, or the like as a shape, and is not particularly limited as long as a drive transmission function can be achieved.

The mesh blade holding members 213 are resin members that are fixedly attached to both end portions of the mesh-shaped outer blades 210. The mesh blade holding members 213 integrally include second facing portions 215 facing the second inner blade 211 in the second direction. The second urging member 216 connected to the second joint member 214 is attached to the second facing portion 215. The second urging member 216 is a coil spring or the like, and allows reciprocating movement of the second inner blade 211 while pressing the second inner blade 211 against a back surface of the mesh-shaped outer blades 210 (that is, a reverse side of the skin contact surface) via the second joint member 214 on the basis of the second facing portion 215. Furthermore, the mesh blade holding members 213 are not limited to resin.

Figure 12:
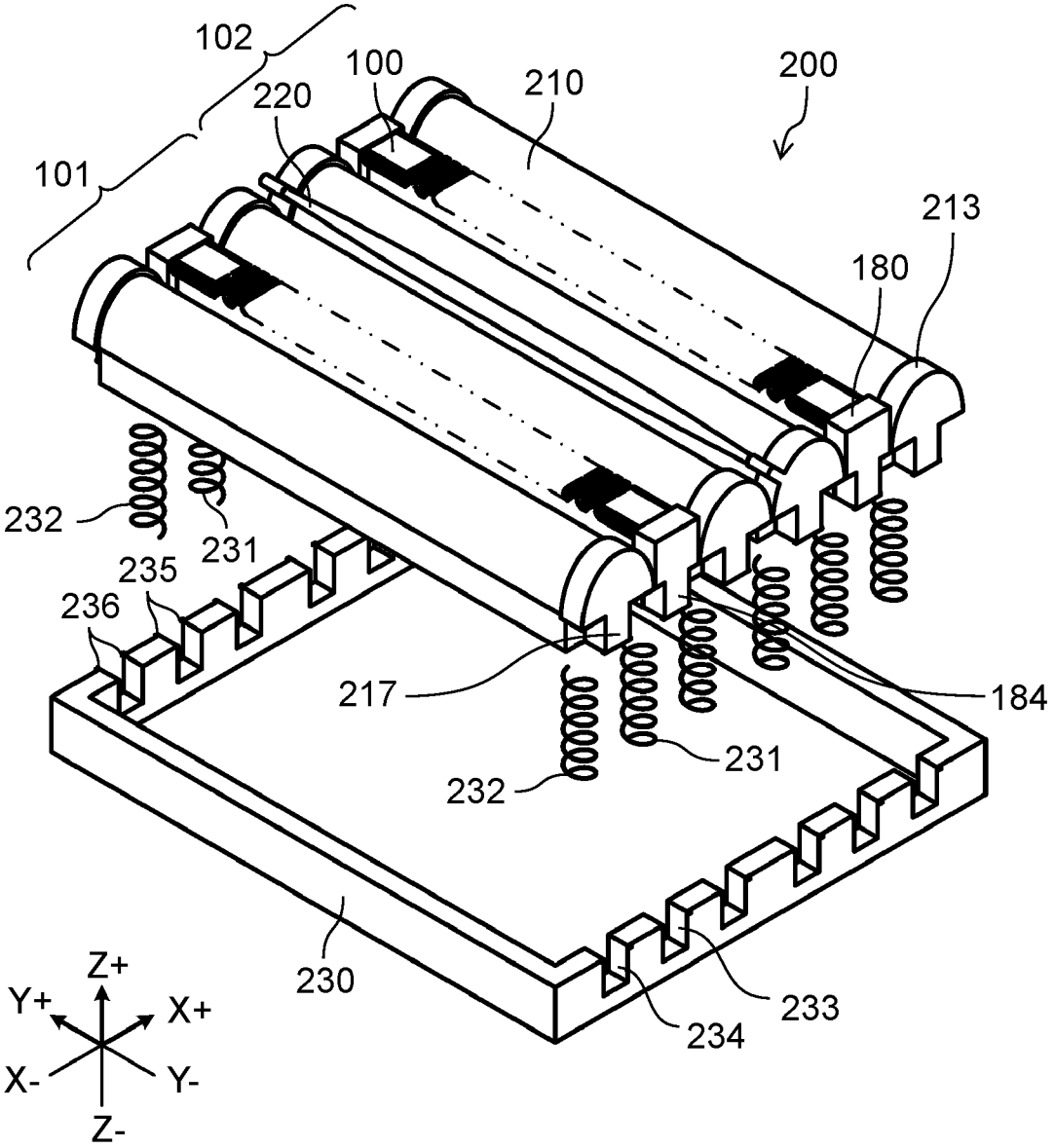
FIG. 12 is a perspective view illustrating the blade unit according to the present exemplary embodiment in an exploded manner.

FIG. 12 is a perspective view illustrating the blade unit 200 in an exploded manner The unit base 230 is a member that movably holds the comb-shaped outer blades 100 and the mesh-shaped outer blades 210 in the second direction (Z-axis direction in the drawing) and in a plane formed by the first direction and the second direction (obliquely). Here, "oblique" means a direction that intersects the Z-axis in the YZ plane. In other words, the movable directions of the comb-shaped outer blades 100 and the mesh-shaped outer blades 210 include not only a direction strictly along the Z-axis but also a direction substantially along the Z-axis. In the case of the present exemplary embodiment, the unit base 230 includes first guide portions 233 that guide the comb-shaped outer blade 100 in the second direction via the comb blade holding members 180 of the comb blade unit 103.

The unit base 230 includes second guide portions 234 that guide the mesh-shaped outer blades 210 in the second direction via the mesh blade holding members 213 of the mesh-shaped blade unit 104. In the case of the present exemplary embodiment, the first guide portions 233 and the second guide portions 234 are provided with grooves penetrating in the first direction and extending in the second direction in a frame portion of the unit base 230. The first guide portions 233 engage with a pair of first ridge portions 184 provided on the comb blade holding members 180, and guide the movement of the comb blade unit 103 in the plane formed by the first direction and the second direction. The second guide portions 234 engage with a pair of second ridge portions 217 provided on the mesh blade holding members 213, and guide the movement of the mesh-shaped blade unit 104 in the plane formed by the first direction and the second direction.

Furthermore, the first guide portions 233 include first regulation portions 235 that regulate an amount of projection of the comb blade unit 103 with respect to the unit base 230, and the second guide portions 234 include second regulation portions 236 that regulate an amount of projection of the mesh-shaped blade unit 104 with respect to the unit base 230. The first regulation portions 235 and the second regulation portions 236 have fixed side protruding portions 280 (see FIG. 13D) provided on a surface portion of the unit base 230 on an outward (Z+ direction in the drawing) side in the second direction. The fixed side protruding portions 280 are formed in a shape projecting in the third direction so as to cover a part of the grooves provided as the first guide portions 233 and the second guide portions 234. Further, the comb blade holding members 180 of the comb blade unit 103 and the mesh blade holding members 213 of the mesh-shaped blade unit 104 are provided with blade unit side protruding portions 290 (see FIG. 13D) protruding in the third direction at end portions in the second direction thereof, and the blade unit side protruding portions 290 face the fixed side protruding portions 280 in the second direction. Due to the first regulation portions 235 and the second regulation portions 236 having such a configuration, when the comb blade unit 103 and the mesh-shaped blade unit 104 are urged and moved outward (Z+ direction in the drawing) in the second direction by comb blade urging members 231 and mesh blade urging members 232, and the blade unit side protruding portions 290 reach positions of the fixed side protruding portions 280, the blade unit side protruding portions 290 come into contact with the fixed side protruding portions 280, so that the comb blade unit 103 and the mesh-shaped blade unit 104 are regulated so as not to project further outward (Z+ direction in the drawing) in the second direction. Then, as illustrated in FIG. 13A, the first regulation portions 235 and the second regulation portions 236 are arranged such that the comb-shaped outer blade 100 of the comb blade unit 103 regulated by the first regulation portions 235 does not project from the mesh-shaped outer blades 210 of the mesh-shaped blade units 104 regulated by the second regulation portions 236.

As illustrated in FIG. 12, the comb blade urging members 231 are members that urge the comb-shaped outer blade 100 outward in the second direction (Z+ direction in the drawing) with respect to the unit base 230. In the case of the present exemplary embodiment, the comb blade urging members 231 are coil springs or the like, and are disposed between the unit base 230 and the comb blade holding members 180 of the comb blade unit 103 at both end portions of the comb blade unit 103 in the first direction. When the comb-shaped outer blade 100 is not pressed in the second direction, the urging force of the comb blade urging members 231 maintain a state in which the movement of the comb blade unit 103 is regulated by the first regulation portions 235 provided on the unit base 230.

The mesh blade urging members 232 are members that urge the mesh-shaped outer blades 210 outward in the second direction (Z+ direction in the drawing) with respect to the unit base 230. In the case of the present exemplary embodiment, the mesh blade urging members 232 are coil springs or the like, and are disposed between the unit base 230 and the mesh blade holding members 213 of the mesh-shaped blade unit 104 at both end portions of the mesh-shaped blade unit 104 in the first direction. In the state where the mesh-shaped outer blades 210 are not pressed in the second direction, the urging force of the mesh blade urging members 232 maintain a state in which the movement of the comb blade unit 103 is regulated by the first regulation portions 235 provided on the unit base 230, and as illustrated in FIG. 13A, top portions of the mesh-shaped outer blades 210 are arranged at positions (Z+side in the drawing) projecting from the comb-shaped outer blade 100 at any position in the first direction.

Figure 13A:
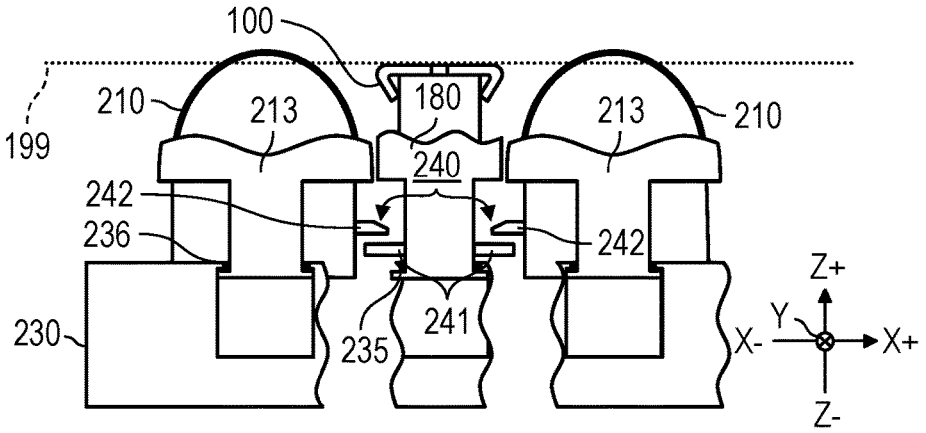
FIG. 13A is a diagram illustrating an operating state of an engaging mechanism according to the present exemplary embodiment.
Figure 13B:
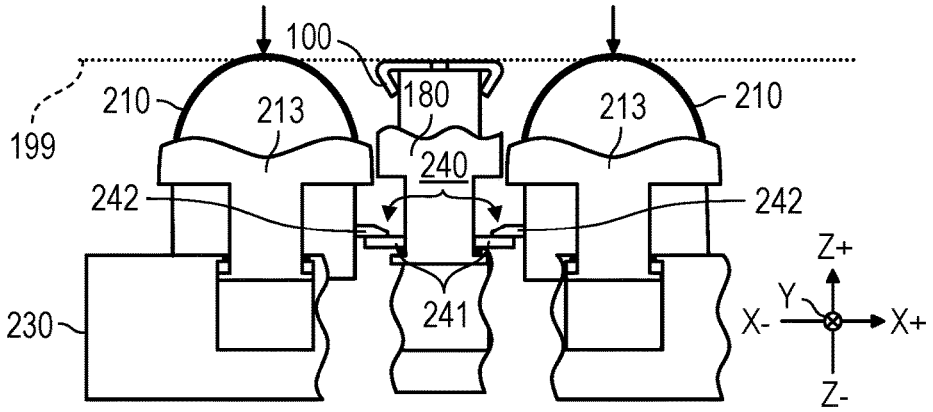
FIG. 13B is a diagram illustrating an operating state of the engaging mechanism according to the present exemplary embodiment.
Figure 13C:
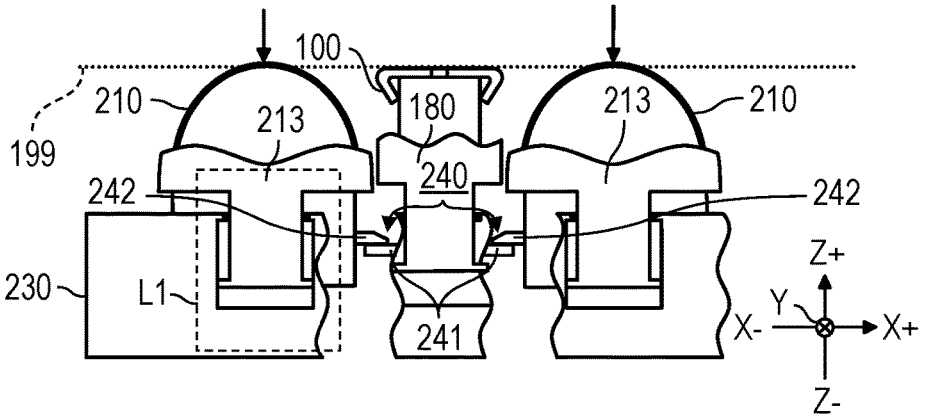
FIG. 13C is a diagram illustrating an operating state of the engaging mechanism according to the present exemplary embodiment.
Figure 13D:
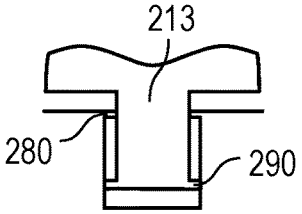
FIG. 13D is an enlarged view of a part surrounded by broken line L1 in FIG. 13C.

FIGS. 13A to 13C are diagrams illustrating an operating state of an engaging mechanism 240. FIG. 13D is an enlarged view of a portion surrounded by broken line L1 in FIG. 13C. The engaging mechanism 240 is a mechanism for moving the comb-shaped outer blade 100 in a state where the comb-shaped outer blade 100 does not project from the mesh-shaped outer blades 210 with respect to the unit base 230 when the mesh-shaped outer blades 210 are moved toward the unit base 230 against the urging force of the mesh blade urging members 232. The specific aspect of the engaging mechanism 240 is not particularly limited, but in the case of the present exemplary embodiment, the engaging mechanism 240 includes first engaging portions 241 and second engaging portions 242.

The first engaging portion 241 is a member capable of regulating the movement of the comb-shaped outer blade 100 in a projecting direction (Z+ direction in the drawing) by engaging with the second engaging portion 242 in the second direction. The arrangement positions and attitudes of the first engaging portions 241 are not particularly limited, but the first engaging portions are provided on the pair of the comb blade holding members 180, which are included in the comb blade unit 103 so as to project toward the mesh-shaped blade unit 104.

The second engaging portions 242 are members capable of transmitting force to the comb blade unit 103 by engaging with the first engaging portions 241, and moving the comb-shaped outer blade 100 toward the unit base 230 against the comb blade urging members 231 when the mesh-shaped blade unit 104 is pressed toward the unit base 230 in the second direction. The arrangement positions of the second engaging portions 242 are located outside the first engaging portions 241 (that is, an upper side in the second direction), and the second engaging portions 242 engage with the first engaging portions 241 to regulate the movement of the comb-shaped outer blade 100 in the second direction such that the comb-shaped outer blade 100 does not project from the mesh-shaped outer blades 210. The second engaging portions 242 are provided at both end portions of the mesh blade holding members 213 included in the mesh-shaped blade unit 104 in the first direction so as to project toward the comb blade unit 103.

The operation mode of the engaging mechanism 240 will be described. In the state where the mesh-shaped outer blades 210 and the comb-shaped outer blade 100 are not pressed (FIG. 13A), the comb-shaped outer blade 100 and the mesh-shaped outer blades 210 project most outward. In this state, the mesh-shaped outer blades 210 project more than the comb-shaped outer blade 100. In FIGS. 13A to 13C, a projecting position of the comb-shaped outer blade 100 is indicated by a broken line at a position 199. In this state, the comb-shaped outer blade 100 and the mesh-shaped outer blades 210 can move independently in a sinking direction (that is, the Z-direction in the drawing).

Next, as illustrated in FIG. 13B, by lightly pressing the electric razor 300 against the skin, the mesh-shaped outer blades 210, which generally project from the comb-shaped outer blade 100, are pressed first, and the mesh-shaped outer blades 210 begin to sink against the mesh blade urging members 232. Then, when the mesh-shaped outer blades 210 sink until the first engaging portions 241 and the second engaging portions 242 of the engaging mechanism 240 are engaged, pressing force is applied from the second engaging portions 242 to the first engaging portions 241, and the comb-shaped outer blade 100 begins to sink in conjunction therewith even in this state, the mesh-shaped outer blades 210 slightly project from the comb-shaped outer blade 100.

Further, as illustrated in FIG. 13C, when the electric razor 300 is pressed against the skin, an engaged state of the first engaging portions 241 and the second engaging portions 242 is maintained, and the mesh-shaped outer blades 210 and the comb-shaped outer blade 100 sink until they are regulated by the unit base 230 while maintaining the state in which the mesh-shaped outer blades 210 are slightly projected from the comb-shaped outer blade 100. In this state, the comb-shaped outer blade 100 can move independently in the sinking direction (that is, the Z-direction in the drawing), but both the mesh-shaped outer blades 210 move in the sinking direction together with the comb-shaped outer blade 100. That is, the first engaging portions 241 and the second engaging portions 242 included in the engaging mechanism 240 are engaged in a direction in which the comb-shaped outer blade 100 projects, and the comb-shaped outer blade 100 is regulated by the engaging mechanism 240 not to project from the mesh-shaped outer blades 210. However, since the engaging mechanism 240 does not regulate the movement of the comb-shaped outer blade 100 in the sinking direction, the comb-shaped outer blade 100 may be pressed and sink depending on the shape of the skin.

Figure 14:
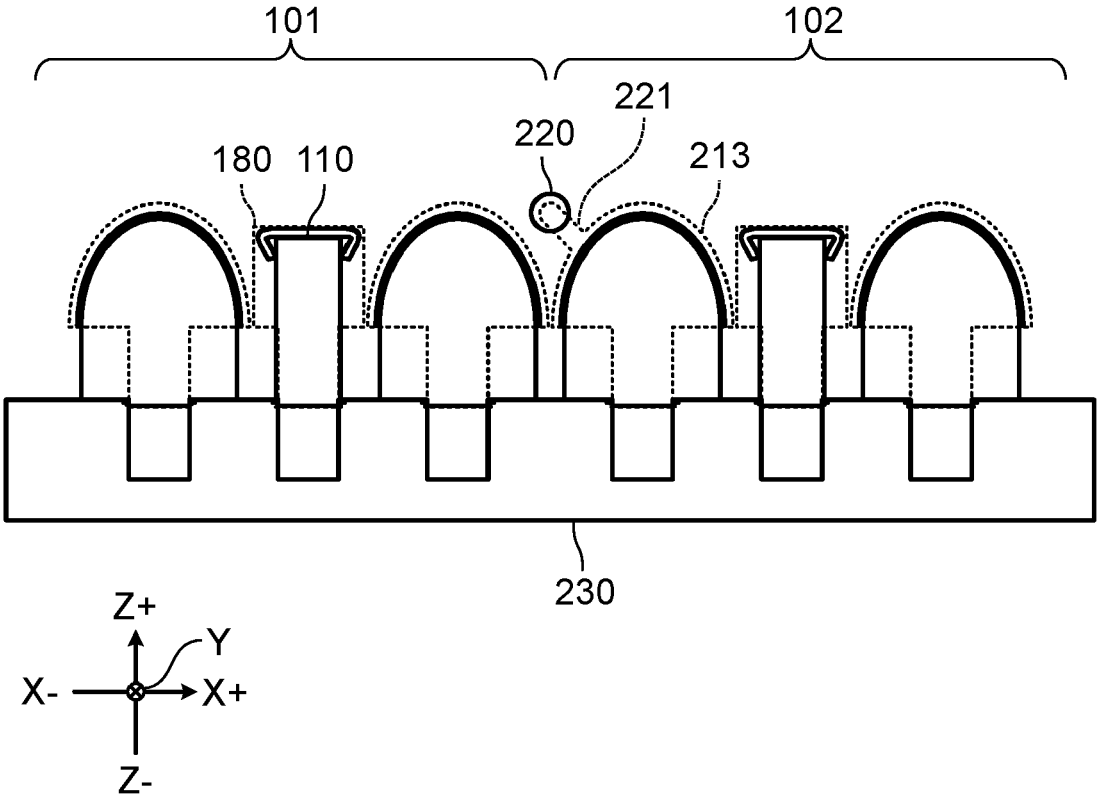
FIG. 14 is a side view illustrating the blade unit in a transparent state of a comb blade holding member and a mesh blade holding member according to the present exemplary embodiment.

FIG. 14 is a side view illustrating the comb blade holding members 180 and the mesh blade holding members 213 in a transparent state in the blade unit 200. The sliding member 220 is a member that, when entire the blade unit 200 is pressed against a wide skin surface, comes into contact with the skin surface, and improves skin sliding when the blade unit 200 is slid against the skin surface. The structure of the sliding member 220 is not particularly limited, but in the case of the present exemplary embodiment, the sliding member 220 is a roller having a rotation axis extending in the first direction (Y-axis direction in the drawing). In the case of the present exemplary embodiment, the sliding member 220 has a shape that bulges such that a diameter of the central portion thereof is larger than that of both end portions thereof so as to correspond to a curved shape in the surface extending in the first direction and the second direction (that is, the YZ plane in the drawing) of the mesh-shaped outer blades 210. Furthermore, the sliding member 220 is disposed so as to project from the mesh-shaped outer blades 210 at any position in the first direction when the blade unit 200 is not pressed.

The sliding member 220 is attached to a holding member that holds an outer blade disposed in the vicinity thereof. In the case of the present exemplary embodiment, the sliding member 220 is rotatably attached to a bearing portion 221 projecting diagonally upward from one of the mesh blade holding members 213 disposed in the nearest vicinity toward adjacent the mesh-shaped outer blades 210. As a result, the sliding member 220 can sink in the second direction together with the mesh-shaped outer blades 210, and can maintain the state in which the sliding member slightly projects from the mesh-shaped outer blades 210. Note that, although the sliding member 220 is attached to the bearing portion 221 in the present exemplary embodiment, the sliding member 220 can also be attached to the unit base 230, for example, but it is preferable that the sliding member is attached to the bearing portion 221 as in the present exemplary embodiment because the projecting state of the sliding member 220 is more stable.

At least two outer blades are arranged on both sides of the sliding member 220. In the case of the present exemplary embodiment, the same number of outer blades are arranged on both sides of the sliding member 220, three each. That is, the blade unit 200 has an even number of outer blades, and the sliding member 220 is arranged in the center thereof. In other words, it is sufficient that two or more outer blades are arranged on both sides of the sliding member 220, and the number of outer blades arranged on both sides of the sliding member 220 is not particularly limited.

Different types of outer blades are arranged on one side of the sliding member 220. In the case of the present exemplary embodiment, one of the outer blades is the comb-shaped outer blade 100, and the other is the mesh-shaped outer blades 210. The blade unit 200 includes the first set 101 and the second set 102 in which the mesh-shaped outer blades 210 are arranged on both sides of the comb-shaped outer blade 100, and the sliding member 220 is arranged between the first set 101 and the second set 102. That is, the mesh-shaped outer blades 210 are arranged immediately on both sides of the sliding member 220. As a result, the sliding member 220 can be arranged in a valley space formed by densely arranged the mesh-shaped outer blades 210, and entire the blade unit 200 can be made compact. Furthermore, the sliding member 220 can prevent the skin from being bitten into the valley space when the blade unit 200 is pressed against the skin to reduce damage to the skin.

In the electric razor 300 and the blade unit 200 directed to the above-described exemplary embodiment, the comb-shaped outer blade 100 does not project more than the mesh-shaped outer blades 210 by the engaging mechanism 240 regardless of the shape of the skin surface and the pressing direction of the electric razor 300 against the skin. Therefore, it is possible to suppress the damage to the skin caused by the tip of a blade of the comb-shaped outer blade 100 strongly biting into the skin. Further, the comb-shaped outer blade 100 can effectively scoop up and cut relatively long body hair that grows along the skin surface on the basis of the shape of the comb-shaped outer blade 100, even when the comb-shaped outer blade 100 does not project more than the mesh-shaped outer blades 210.

Note that the present disclosure is not limited to the above exemplary embodiment. For example, another exemplary embodiment achieved by arbitrarily combining the components described in the present specification or excluding some of the components may be an exemplary embodiment of the present disclosure. Further, the present disclosure also includes modifications obtained by making various modifications to the above-described exemplary embodiment, which are conceivable by those skilled in the art without departing from the spirit of the present disclosure, that is, the meaning indicated by the wording described in the claims.

For example, in the above-described exemplary embodiment, the case of six blades has been described, but the blade unit 200 may have any number of blades as long as the blade unit 200 includes the comb-shaped outer blade 100 and the mesh-shaped outer blades 210.

Further, as the comb-shaped outer blade 100, the case where the open blade portions 130 and the bent blade portions 140 are alternately arranged with the slit extending in the third direction interposed therebetween has been described, but the shape of the comb-shaped outer blade 100 is not limited thereto.

Figure 15:
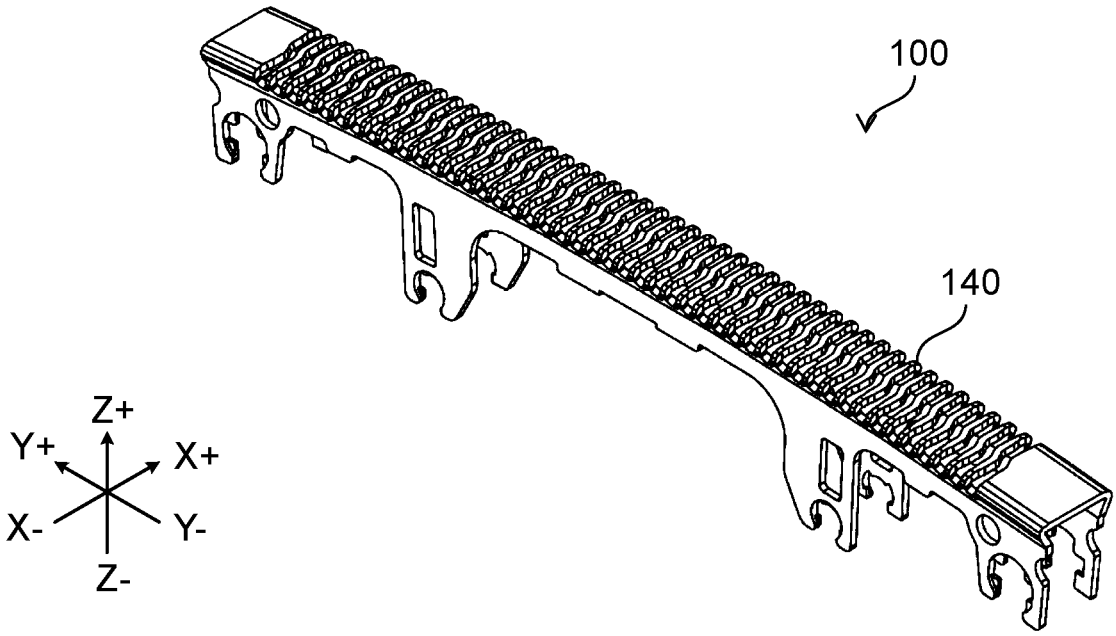
FIG. 15 is a perspective view illustrating first another example of the shape of a comb-shaped outer blade.

For example, as illustrated in FIG. 15, the comb-shaped outer blade 100 may be formed by all the bent blade portions 140 without comprising the open blade portions 130. As a result, since the base portion 110 does not exist and the slit penetrates in the third direction, long hair facing in the opposite direction can also be shaved.

Figure 16:
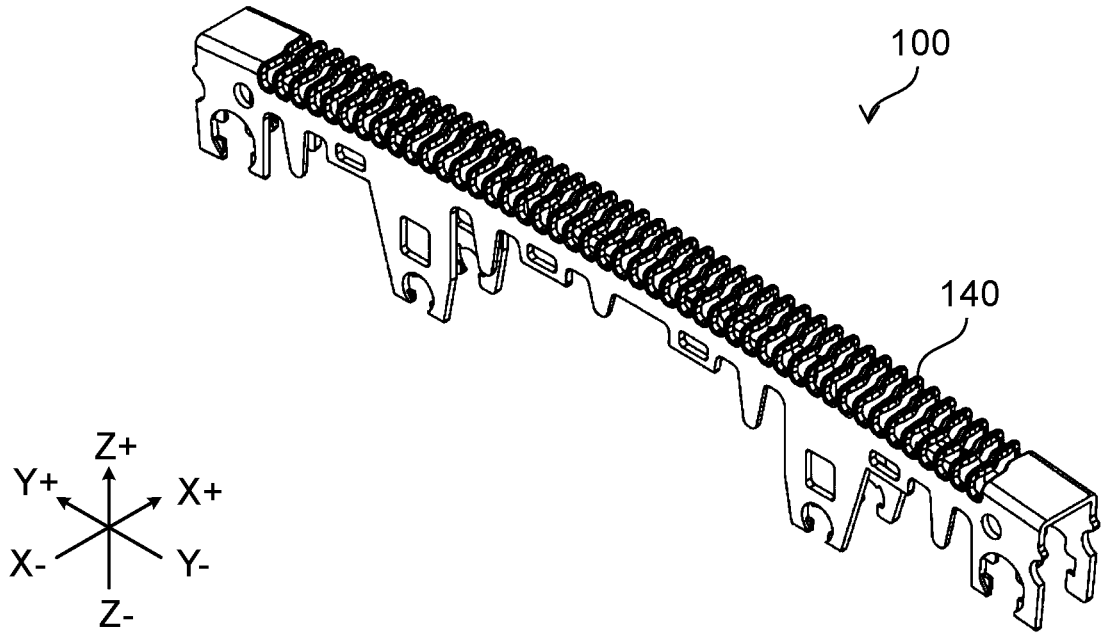
FIG. 16 is a perspective view illustrating second another example of the shape of the comb-shaped outer blade.

Further, as illustrated in FIG. 16, the bent blade portion 140 may be bent by about 90° instead of an acute angle. As a result, long hair can be cut with improved touch on the skin.

Figure 17:
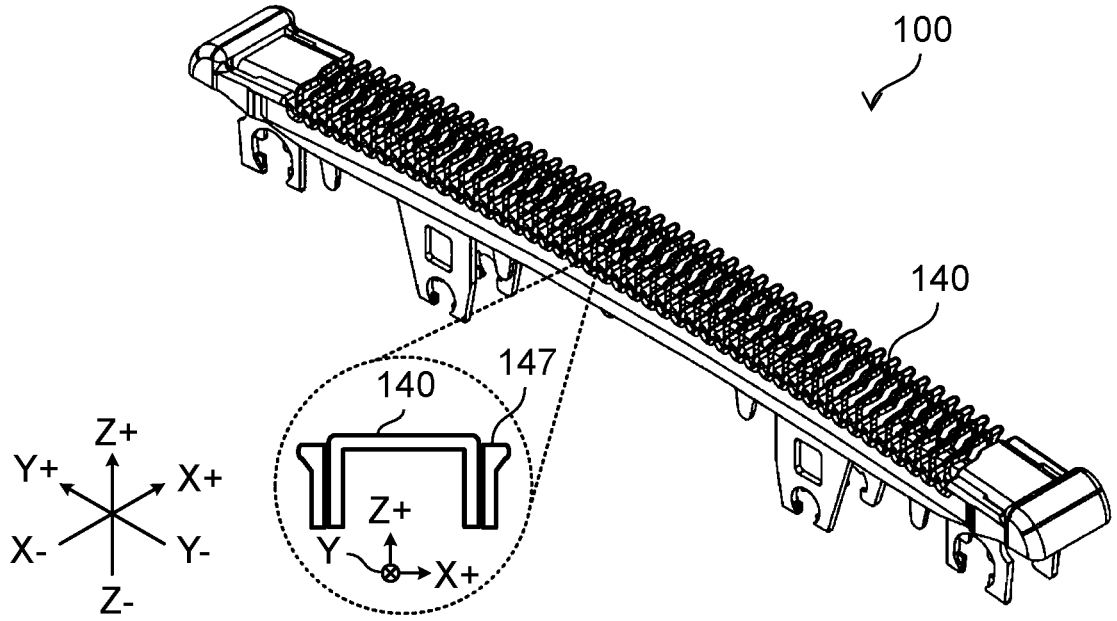
FIG. 17 is a perspective view illustrating third another example of the shape of the comb-shaped outer blade.

Furthermore, as illustrated in FIG. 17, another member 147 (for example, a comb member) adjacent to the bent blade portion 140 in the third direction may be provided. This makes it possible to improve the shaving performance of long hair.

Figure 18:
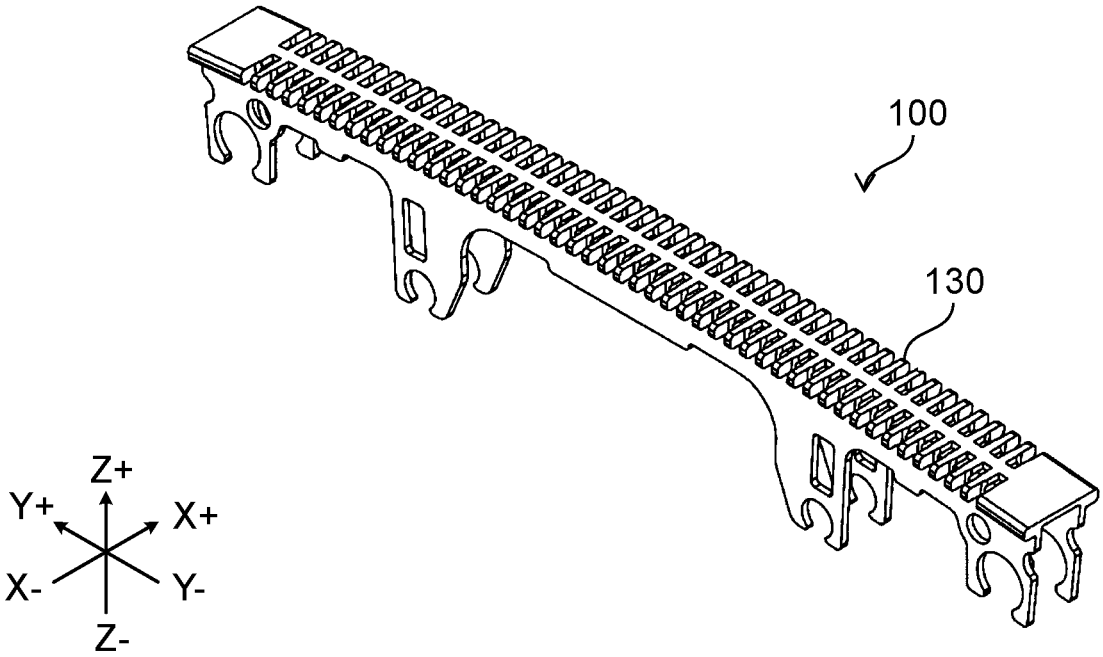
FIG. 18 is a perspective view illustrating fourth another example of the shape of the comb-shaped outer blade.

Further, as illustrated in FIG. 18, the comb-shaped outer blade 100 may be formed by all the open blade portions 130 without comprising the bent blade portions 140. This makes it possible to improve the shaving performance of long hair.

Figure 19:
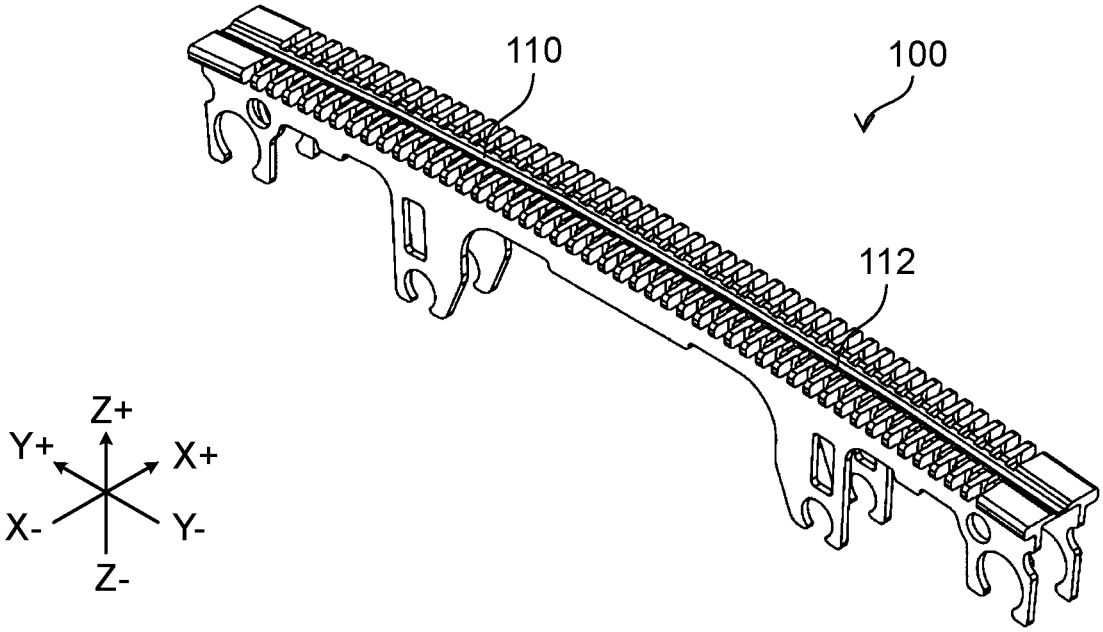
FIG. 19 is a perspective view illustrating fifth another example of the shape of the comb-shaped outer blade.

Further, as illustrated in FIG. 19, a part of the base portion 110 may be provided with recess portion 112 that is recessed in the second direction and extends in the first direction. As a result, it is possible to increase the possibility of re-standing long hair that has not been scooped and introducing it into the slit, and to improve the shaving performance of the long hair.

Figure 20:
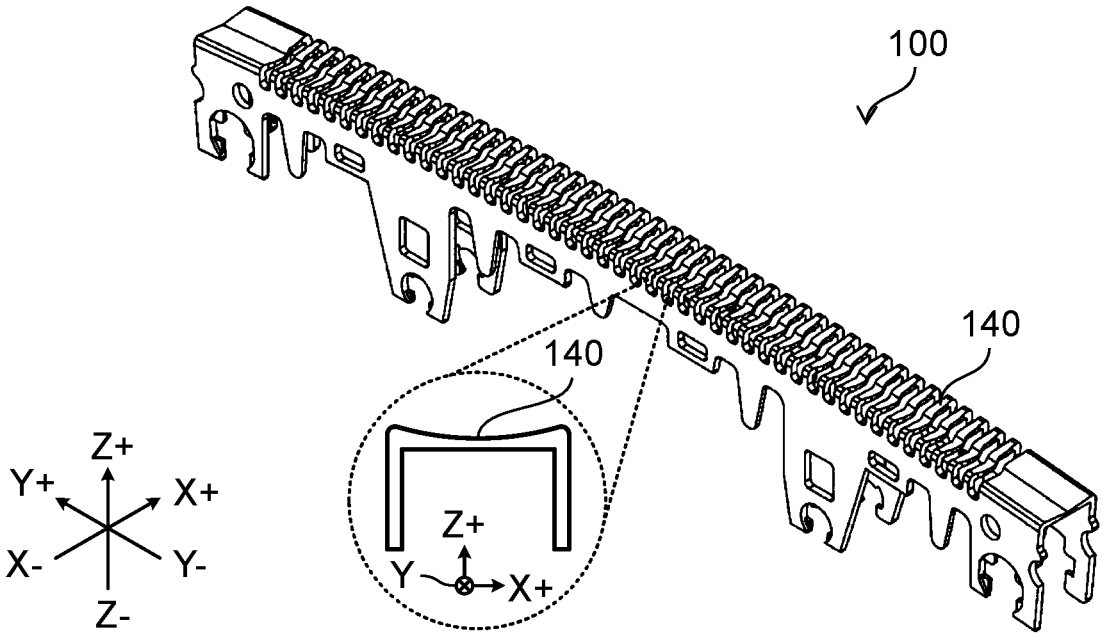
FIG. 20 is a perspective view illustrating sixth another example of the shape of the comb-shaped outer blade.

Further, as illustrated in FIG. 20, in the third direction, both end portions of the bent blade portion 140 may project outward in the second direction. This makes it possible to improve the shaving performance of long hair.

Figure 21:
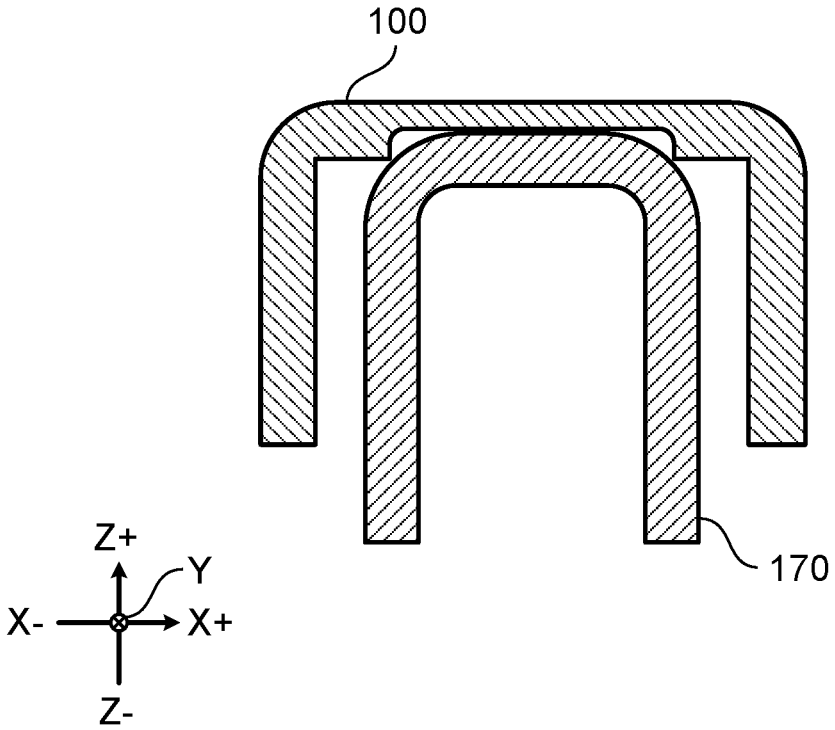
FIG. 21 is a cross-sectional view illustrating seventh another example of the shape of the comb-shaped outer blade.

Further, as illustrated in FIG. 21, the wall thickness of a part of the comb-shaped outer blade 100 in contact with the first inner blade 170 may be reduced. Thereby, the comb-shaped outer blade 100 can shave long hair shorter, and the mesh-shaped outer blades 210 can shave body hair to a length that is easy to insert.

Further, the plurality of the bent blade portions 140 may be arranged between adjacent the open blade portions 130, and the plurality of the open blade portions 130 may be arranged between adjacent the bent blade portions 140.

Further, the comb-shaped outer blade 100 and the mesh-shaped outer blades 210 may be not only integrally shaped from sheet metal but also formed by joining a plurality of members by welding or the like. Specifically, for example, the base portion 110 and at least one of the open blade portions 130 and the bent blade portions 140 are integrally formed, and the comb-shaped outer blade 100 may be formed by joining the long end portion 111 and the attaching portion 120, both of which have been separately formed, to the base portion 110 and the other of the open blade portions 130 and the bent blade portions 140 by welding or the like.

Further, although the open blade portions 130 and the bent blade portions 140 are arranged symmetrically with respect to the base portion 110, the open blade portions 130 and the bent blade portions 140 may be arranged side by side in the third direction.

Further, the width of a tip end portion (that is, the length in the first direction) of the open blade portion 130 may be narrower than the width of the base end portion 158, similarly to the bent blade portion 140.

Further, although the case where the blade unit 200 can be attached to and detached from the head portion 320 together with the unit base 230 has been described, the head portion 320 may have a portion having the same function as the unit base 230.

Further, although the first regulation portions 235 and the second regulation portions 236 that regulate the projection amount of the comb blade unit 103 and the mesh-shaped blade unit 104 with respect to the unit base 230 have been described, the structure that regulates the projection amount of the comb-shaped outer blade 100 and the mesh-shaped outer blades 210 is not limited to this. For example, the unit base 230 is provided with a groove extending in the second direction and having both of closed end portions in an extending direction, and either the comb blade unit 103 or the mesh-shaped blade unit 104 may be provided with a protrusion that is inserted into the groove of the unit base 230 and moves along the groove. In this case, the amount of projection is regulated by the protrusion coming into contact with the end portion of the groove. Further, with respect to the groove and the protrusion, contrary to the above-described structure, the unit base 230 may be provided with the protrusion, and the comb blade unit 103 and the mesh-shaped blade unit 104 may be provided with the groove.

Further, the regulation portions that regulates the projection amount of the comb blade unit 103 and the mesh-shaped blade unit 104 with respect to the unit base 230 are not limited to the unit base 230, the comb blade unit 103, and the mesh-shaped blade unit 104, and regulation portions may be provided at other positions according to the projection amount.

The present disclosure can be applied to an electric razor capable of shaving body hair of animals including humans, such as a so-called electric shaver for shaving a beard.

What is claimed is:

1. An electric razor comprising:

a head portion comprising:

a comb-shaped outer blade extending in a first direction;

at least two mesh-shaped outer blades extending in the first direction, the comb-shaped outer blade being disposed between the at least two mesh-shaped outer blades; and a unit base that holds the comb-shaped outer blade and the at least two mesh-shaped outer blades so as to be movable in a second direction intersecting the first direction, a comb blade urging member configured to urge the comb-shaped outer blade with respect to the unit base in the second direction;

at least two a mesh blade urging members configured to urge the at least two mesh-shaped outer blades with respect to the unit base in the second direction; and an engaging mechanism configured to cause the comb-shaped outer blade to move in a state where a height of a top of the comb-shaped outer blade from the unit base is equal to or lower than a height of a top of the at least two mesh-shaped outer blades from the unit base, when the at least two mesh-shaped outer blades are moved toward the unit base against urging force of the at least two mesh blade urging members, wherein:

the engaging mechanism comprises:

a first engaging portion that protrudes from the comb-shaped outer blade toward a side of the at least two mesh-shaped outer blades in a third direction intersecting the first direction and the second direction; and a second engaging portion that protrudes from the at least two mesh-shaped outer blades toward a side of the comb-shaped outer blade in the third direction, and in the second direction, the first engaging portion is disposed at a position closer to the unit base than the second engaging portion is, and the first engaging portion and the second engaging portion engage with each other in the state where the height of the top of the comb-shaped outer blade from the unit base is equal to or lower than the height of the top of the at least two mesh-shaped outer blades from the unit base.

2. The electric razor according to claim 1, wherein the comb-shaped outer blade comprises:

a base portion having a rod shape extending in the first direction; and an open blade portion having a cantilever rod shape and protruding from the base portion in a direction intersecting the first direction.

3. The electric razor according to claim 2, comprising:

an attaching portion having a plate shape and extending in the first direction and the second direction which intersects the first direction; and a bent blade portion that connects the base portion and the attaching portion, wherein the bent blade portion comprises:

a projecting portion projecting from the base portion along the third direction intersecting the first direction and the second direction;

a connecting portion attached to the attaching portion; and a bent portion connecting the projecting portion and the connecting portion.

4. The electric razor according to claim 3, wherein the connecting portion is inclined in such a manner that the connecting portion approaches the base portion in the third direction as a distance from the bent portion increases in the second direction and that the connecting portion connects the bent portion with the attaching portion.

5. The electric razor according to claim 3, wherein in the third direction intersecting the first direction and the second direction, an end surface of the bent portion is disposed at a position farther from a tip surface of the open blade portion with respect to the base portion.

6. The electric razor according to claim 1, wherein the comb-shaped outer blade is curved in such a manner that the central portion thereof protrudes from both end portions thereof in a plane extending in the first direction and the second direction.

7. The electric razor according to claim 1, wherein the at least two mesh-shaped outer blades are curved in such a manner that the central portion of each of the at least two mesh-shaped outer blades protrudes from both end portions of each of the at least two mesh-shaped outer blades in a plane extending in the first direction and the second direction.

8. The electric razor according to claim 1, wherein the comb-shaped outer blade and the at least two mesh-shaped outer blades are curved in such a manner that the central portion of each of the comb-shaped outer blade and the at least two mesh-shaped outer blades protrudes from both end portions of each of the comb-shaped outer blade and the at least two mesh-shaped outer blades in a plane extending in the first direction and the second direction.

9. A blade unit configured to be attached to an electric razor, comprising:

a comb-shaped outer blade extending in a first direction;

at least two mesh-shaped outer blades extending in the first direction, the comb-shaped outer blade being disposed between the at least two mesh-shaped outer blades;

a unit base that holds the comb-shaped outer blade and the at least two mesh-shaped outer blades so as to be movable in a second direction intersecting the first direction;

a comb blade urging member configured to urge the comb-shaped outer blade with respect to the unit base in the second direction;

at least two mesh blade urging members configured to urge the at least two mesh-shaped outer blades with respect to the unit base in the second direction; and an engaging mechanism configured to cause the comb-shaped outer blade to move in a state where a height of a top of the comb-shaped outer blade from the unit base is equal to or lower than a height of a top of the at least two mesh-shaped outer blades from the unit base, when the at least two mesh-shaped outer blades are moved toward the unit base against urging force of the at least two mesh blade urging members, wherein the engaging mechanism comprises:

a first engaging portion that protrudes from the comb-shaped outer blade toward a side of the at least two mesh-shaped outer blades in a third direction intersecting the first direction and the second direction; and a second engaging portion that protrudes from the at least two mesh-shaped outer blades toward a side of the comb-shaped outer blade in the third direction, and in the second direction, the first engaging portion is disposed at a position closer to the unit base than the second engaging portion is, and the first engaging portion and the second engaging portion engage with each other in the state where the height of the top of the comb-shaped outer blade from the unit base is equal to or lower than the height of the top of the at least two mesh-shaped blades from the unit base.

* * * * *